US011412825B2

(12) United States Patent
Augustinowicz

(10) Patent No.: US 11,412,825 B2
(45) Date of Patent: Aug. 16, 2022

(54) SHIELDING CARD HOLDER SYSTEM

(71) Applicant: Identity Stronghold, LLC, Englewood, FL (US)

(72) Inventor: Walter P. Augustinowicz, Englewood, FL (US)

(73) Assignee: Identity Stronghold, LLC, Englewood, FL (US)

( * ) Notice: Subject to any disclaimer, the term of this patent is extended or adjusted under 35 U.S.C. 154(b) by 170 days.

(21) Appl. No.: 17/089,363

(22) Filed: Nov. 4, 2020

(65) Prior Publication Data

US 2022/0133008 A1 May 5, 2022

(51) Int. Cl.
*A45C 11/18* (2006.01)

(52) U.S. Cl.
CPC ..... *A45C 11/182* (2013.01); *A45C 2011/186* (2013.01); *A45F 2200/055* (2013.01)

(58) Field of Classification Search
CPC ..... A45C 11/182; A45C 2011/186; A45F 2200/055
USPC ..... 150/147; 206/818
See application file for complete search history.

(56) References Cited

U.S. PATENT DOCUMENTS

| | | | |
|---|---|---|---|
| 211,725 | A | 1/1879 | Foster |
| 638,561 | A | 12/1899 | Cook |
| 915,124 | A | 3/1909 | Sprague |
| 4,340,770 | A | 7/1982 | Bridges |
| 4,647,714 | A | 3/1987 | Goto |
| 4,674,628 | A | 6/1987 | Prinsloo |
| 4,697,698 | A | 10/1987 | Holdener |
| 4,851,610 | A | 7/1989 | LeBlanc |
| 5,005,106 | A | 4/1991 | Kiku |
| 5,080,223 | A | 1/1992 | Mitsuyama |
| 5,125,505 | A | 6/1992 | Kurosaki |
| 5,227,614 | A | 7/1993 | Danielson |

(Continued)

FOREIGN PATENT DOCUMENTS

| | | | |
|---|---|---|---|
| JP | 2003099742 | A | 4/2003 |
| KR | 1020090088057 | A | 8/2009 |

(Continued)

OTHER PUBLICATIONS

PCT Search Report for PCT/US07/015122; dated Mar. 7, 2008.

(Continued)

*Primary Examiner* — John K Fristoe, Jr.
*Assistant Examiner* — Jessica Kavini Tamil
(74) *Attorney, Agent, or Firm* — Neustel Law Offices

(57) ABSTRACT

A shielding card holder system for providing a versatile protector and holder which shields wireless transmissions from a card such as a smartcard. The shielding card holder system generally includes a card protector adapted to shield wireless transmissions from a card such as a smartcard. A card holder is removably attached to the card protector, the card holder being adapted to removably receive cards of varying thicknesses. A protector magnet on the card protector is adapted to magnetically engage with a holder magnet on the card holder or the card holder itself to removably attach the card holder to the card protector. A securing member may be utilized to secure the card protector against an article of clothing, with the securing member including a securing magnet adapted to magnetically engage with the protector magnet through the clothing.

20 Claims, 21 Drawing Sheets

(56) References Cited

U.S. PATENT DOCUMENTS 5,288,942 A 2/1994 Godfrey
5,337,813 A 8/1994 Ritter
5,369,899 A * 12/1994 Reeves ..... G09F 7/12 40/621
5,564,166 A * 10/1996 Roy ..... G09F 3/207 24/24
5,880,769 A 3/1999 Nemirofsky
6,002,605 A 12/1999 Iwasaki
6,085,449 A 7/2000 Tsui
6,121,544 A 9/2000 Petsinger
6,127,938 A 10/2000 Friedman
6,155,410 A 12/2000 Davis
6,470,284 B1 10/2002 Oh
6,634,564 B2 10/2003 Kuramochi
6,659,356 B2 12/2003 Kashima
6,744,537 B1 6/2004 Chiba
6,752,305 B2 6/2004 Shattuck
6,845,863 B1 1/2005 Riley
6,876,552 B2 4/2005 Pan
6,883,718 B1 4/2005 Le
6,991,483 B1 1/2006 Milan
7,083,083 B2 8/2006 Droz
7,137,563 B2 11/2006 Shibamoto
7,243,840 B2 7/2007 Bason
7,308,771 B2 * 12/2007 Memelink ..... G09F 3/20 150/147
7,319,398 B2 1/2008 Marino
7,598,875 B2 10/2009 Noguchi
7,635,089 B2 12/2009 Augustinowicz
7,667,652 B2 2/2010 Gevargiz
7,830,322 B1 11/2010 Oliver
7,918,335 B1 4/2011 Kitchen
3,038,068 A1 10/2011 Yuzon
8,544,743 B2 10/2013 Hong
8,698,630 B2 4/2014 Augustinowicz
9,594,934 B2 3/2017 Augustinowicz
9,697,453 B2 * 7/2017 Augustinowicz ..... G06K 19/07318
10,943,514 B1 * 3/2021 O'Keefe ..... G09F 7/10
2002/0071212 A1 6/2002 Rogers
2003/0066893 A1 4/2003 Yap
2004/0045133 A1 * 3/2004 Buettell ..... A45F 5/02 24/3.12
2004/0069853 A1 4/2004 Aharonson
2004/0129785 A1 7/2004 Luu
2004/0148837 A1 8/2004 Lewis
2005/0077348 A1 4/2005 Hendrick
2005/0183579 A1 8/2005 Bowers
2005/0189425 A1 9/2005 Itou
2005/0192053 A1 9/2005 Kao
2005/0236489 A1 10/2005 Droz
2006/0017570 A1 1/2006 Moskowitz
2006/0027593 A1 2/2006 Slocum
2006/0044206 A1 3/2006 Moskowitz
2006/0180674 A1 8/2006 Margalit
2006/0187055 A1 8/2006 Colby
2006/0187061 A1 8/2006 Colby
2006/0197213 A1 9/2006 Lian
2006/0219776 A1 10/2006 Finn
2006/0236117 A1 10/2006 Lazaridis
2006/0278723 A1 12/2006 Dan
2006/0282993 A1 * 12/2006 Dietz ..... B43K 23/001 24/303
2007/0040017 A1 2/2007 Kozlay
2007/0099662 A1 5/2007 Gallagher
2007/0108296 A1 5/2007 Konopka
2007/0109130 A1 5/2007 Edenfield
2007/0150336 A1 6/2007 Boily
2007/0157494 A1 7/2007 Barcikowski
2007/0289775 A1 12/2007 Potts
2008/0101273 A1 5/2008 Everest
2008/0190526 A1 8/2008 O'Shea
2008/0308640 A1 12/2008 Chien
2009/0045960 A1 2/2009 Gutfield
2009/0159663 A1 6/2009 Mullen
2009/0166421 A1 7/2009 Finn
2009/0206994 A1 8/2009 Lee
2010/0156607 A1 6/2010 Lankes
2011/0272464 A1 11/2011 Rancien
2012/0043382 A1 2/2012 Hong
2012/0112887 A1 5/2012 Horne
2012/0228168 A1 9/2012 Kitchen
2013/0049963 A1 2/2013 Augstinowicz
2013/0233924 A1 9/2013 Burns
2014/0203020 A1 7/2014 Trombino
2015/0077229 A1 3/2015 Augstinowicz
2016/0042208 A1 2/2016 Augstinowicz
2017/0032236 A1 2/2017 Augstinowicz
2020/0163443 A1 * 5/2020 Huang ..... A45F 5/02

FOREIGN PATENT DOCUMENTS

KR 2020090012142 U 12/2009
WO 2004036495 A1 4/2004
WO 2010108022 A1 9/2010

OTHER PUBLICATIONS

PCT Search Report and Opinion for PCT/US2012/044106; dated Jan. 3, 2013.
European Patent Office Search Report and Opinion for EU Application No. 12826259.9; dated Feb. 5, 2015.
PCT Search Report and Opinion for PCT/US2014/064557; dated Feb. 11, 2015.
http://www.alldatasheet.com/datasheet-pdf/pdf/255413/ATMEL/ATA5577.html; Data Sheet from Atmel for the Read/Write LF RFID IDIC 100 to 150 kHz; Mar. 4, 2014.
PCT Search Report and Opinion for PCT/US2015/044490; dated Nov. 16, 2015.
http://www.idstronghold.com/Secure-Badgeholder-Classic-IDSH1004-001B-002-/productinfo/IDSH1004-/; Identity Stronghold Webpage for Secure Badgeholder Classic, product by inventor Walt Augustinowicz; Jun. 2, 2007.
PCT Search Report and Opinion for PCT/US2011/022312; dated Sep. 23, 2011.

* cited by examiner

SHIELDING CARD HOLDER SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

Field

Example embodiments in general relate to a shielding card holder system for providing a versatile protector and holder which shields wireless transmissions from a card such as a smartcard.

Related Art

Any discussion of the related art throughout the specification should in no way be considered as an admission that such related art is widely known or forms part of common general knowledge in the field.

The use of electric and magnetic cards has become ubiquitous in modern society. Cards such as badges, credit cards, identifying cards, access cards, and the like are a staple of modern life. While many such cards utilize magnetic strips, modern technology has allowed for the use of cards which utilize electronic devices such as chips to wirelessly transfer information.

Such cards are susceptible to intrusions such as skimming, in which an electronic device may be utilized to scan the card for cloning or data theft. Most modern smart phones include near-field communication (NFC) functionality which may allow the smart phone to scan the data from the card.

While various methods have been utilized to prevent such skimming, the methods in use often severely inhibit the versatility of the card, particularly with respect to accessibility to the card and options for how to wear or otherwise attach the card to one's self. For example, foil or similar sleeves require that the sleeve be retrieved from a wallet or purse and then that the card be fully removed from the sleeve.

SUMMARY

An example embodiment is directed to a shielding card holder system. The shielding card holder system includes a card protector adapted to shield wireless transmissions from a card such as a smartcard. A card holder is removably attached to the card protector, the card holder being adapted to removably receive the card. A protector magnet on the card protector is adapted to magnetically engage with a holder magnet on the card holder or the card holder itself to removably attach the card holder to the card protector. A securing member may be utilized to secure the card protector against an article of clothing, with the securing member including a securing magnet adapted to magnetically engage with the protector magnet through the clothing.

There has thus been outlined, rather broadly, some of the embodiments of the shielding card holder system in order that the detailed description thereof may be better understood, and in order that the present contribution to the art may be better appreciated. There are additional embodiments of the shielding card holder system that will be described hereinafter and that will form the subject matter of the claims appended hereto. In this respect, before explaining at least one embodiment of the shielding card holder system in detail, it is to be understood that the shielding card holder system is not limited in its application to the details of construction or to the arrangements of the components set forth in the following description or illustrated in the drawings. The shielding card holder system is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

A. Overview

Figure 1:
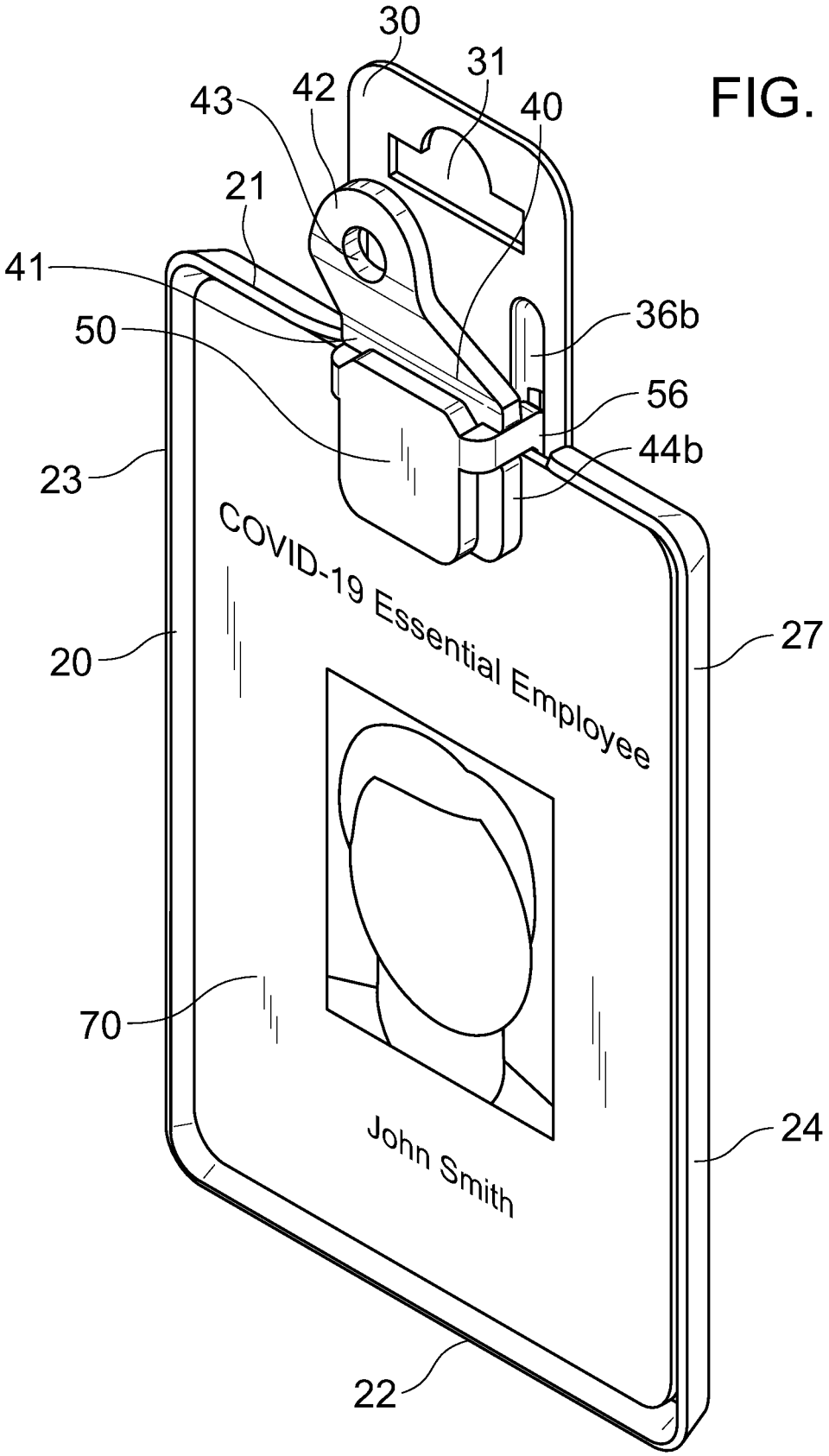
FIG. 1 is a perspective view of a shielding card holder system in accordance with an example embodiment.

An example shielding card holder system generally comprises a card protector 20 for shielding wireless transmissions from a card 70. The card protector 20 comprises an upper end 21, a lower end 22, an outer surface 25, and an inner surface 26. An outer flange 27 may extend at least partially around an outer edge of the outer surface 25 of the card protector 20. A first protector magnet 33 is connected to the card protector 20, with the first protector magnet 33 including a first surface 80 and a second surface 81 opposite of the first surface 80. A card holder 40 adapted to removably hold the card 70 within the card holder 40 is removably attached to the outer surface 25 of the card protector 20. The card holder 40 is adjustable between an opened position and a closed position. The card holder 40 is adapted to removably hold the card 70 within the card holder 40 when the card holder 40 is in the closed position. The card holder 40 is adapted to magnetically engage with the first surface 80 of the first protector magnet 33 so as to removably attach the card holder 40 to the card protector 20.

A securing member 60 may be removably attached the inner surface 26 of the card protector 20. A first securing magnet 64 is connected to the securing member 60. The first securing magnet 64 is adapted to magnetically engage with the second surface 81 of the first protector magnet 33 so as to removably attach the securing member 60 to the card protector 20. A second protector magnet 35 may be connected to the card protector 20 and a second securing magnet 66 may be connected to the securing member 60. The second securing magnet 66 is adapted to magnetically engage with the second protector magnet 35 so as to removably attach the securing member 60 to the card protector 20.

The first protector magnet 33 is connected near the upper end 21 of the card protector 20 and the second protector magnet 35 is connected near the lower end 22 of the card protector 20. The first securing magnet 64 is connected near the upper end 61 of the securing member 60 and the second securing magnet 66 is connected near the lower end 62 of the securing member 60. The securing member 60 may comprise one or more openings 67.

The card holder 40 comprises a first member 41 and a second member 50. The first member 41 and the second member 50 are movably connected such that the card holder 40 is adjustable between an opened position and a closed position. The card holder 40 comprises a bias member 49 for biasing the card holder 40 towards the closed position. The bias member 49 is connected between the first member 41 and the second member 50 of the card holder 40. The bias member 49 may comprise a leaf spring. The bias member 49 may comprise a magnetic material. A fastener 48 may be connected between the first member 41 and the second member 50 of the card holder 40. The fastener 48 may be rotatable to adjust the card holder 40 between the opened position and the closed position.

Another example shielding card holder system generally comprises a card protector 20 for shielding wireless transmissions from a card 70. The card protector 20 may comprise an upper end 21, a lower end 22, an outer surface 25, and an inner surface 26. The card protector 20 may include an outer flange 27 extending at least partially around an outer edge of the outer surface 25 of the card protector 20. A first protector magnet 33 may be connected to the card protector 20. The first protector magnet 33 may include a first surface 80 and a second surface 81 opposite of the first surface 80.

A card holder 40 may be removably attached to the outer surface 25 of the card protector 20. The card holder 40 is adapted to removably hold the card 70 within the card holder 40 and is adjustable between an opened position and a closed position. A first holder magnet 47 may be connected to the card holder 40 to magnetically engage with the first surface 80 of the first protector magnet 33 so as to removably attach the card holder 40 to the card protector 20.

A securing member 60 may be removably attached to the inner surface 26 of the card protector 20. A first securing magnet 64 may be connected to the securing member 60 so as to magnetically engage with the second surface 81 of the first protector magnet 33 to removably attach the securing member 60 to the card protector 20. A second protector magnet 35 may be connected to the card protector 20. A second securing magnet 66 may be connected to the securing member 60. The second securing magnet 66 is adapted to magnetically engage with the second protector magnet 35 so as to removably attach the securing member 60 to the card protector 20.

The card holder 40 may comprise a first member 41 and a second member 50, with the first member 41 being movable with respect to the second member 50 so as to adjust the card holder 40 between the opened position and the closed position. The first holder magnet 47 may be connected to the first member 41 and a second holder magnet 53 may be connected to the second member 50. The first holder magnet 47 and the second holder magnet 53 are adapted to magnetically bias the card holder 40 towards the closed position.

Also disclosed is a method of wearing a card 70 utilizing the shielding card holder system, comprising the steps of securing the card 70 within the card holder 40, attaching the card holder 40 to the card protector 20, positioning the securing member 60 against the interior of an article of clothing 13, and positioning the card protector 20 against the exterior of the article of clothing 13 adjacent to the securing member 60 such that the first protector magnet 33 of the card protector 20 magnetically engages with the first securing magnet 64 of the securing member 60 through the article of clothing 13.

B. Card Protector

As shown throughout the figures, the shielding card holder system may comprise a card protector 20 to which a card 70 may be secured, such as with a card holder 40 as described herein. The card protector 20 may provide a number of functions. It may act as a backing for the card 70 so as to lessen the risk of damage to the back of the card 70, and particularly any electronic or magnetic strips. The card protector 20 may also act to shield wireless signals such as RF waves and the like so as to protect the card 70 from intrusions such as being cloned or skimmed.

The card protector 20 may comprise various types of materials known to shield wireless transmissions, such as but not limited to metals, metal alloys, and the like. By way of example and without limitation, the card protector 20 may be at least partially comprised of shielding materials such as aluminum, copper, nickel, brass, silver, steel, tin, and alloys thereof. In some embodiments, only portions of the card protector 20 may be comprised of such shielding materials. In other embodiments, all of the card protector 20 may comprise such materials. In some embodiments, the shielding materials may be connected to, rather than integrated with, the card protector 20. For example, a shielding material such as a plate or cover may be connected to the outer or inner surfaces 25, 26 of the card protector 20.

The card protector 20 may comprise various shapes and dimensions depending on the card 70 to be shielded, as well as other considerations such as where the card protector 20 is meant to be worn. In the exemplary embodiments shown in the figures, the card protector 20 is illustrated as comprising a rectangular shape. It should be appreciated that the figures merely illustrate an exemplary embodiment of the card protector 20 and thus should not be construed as limiting in scope.

Figure 2:
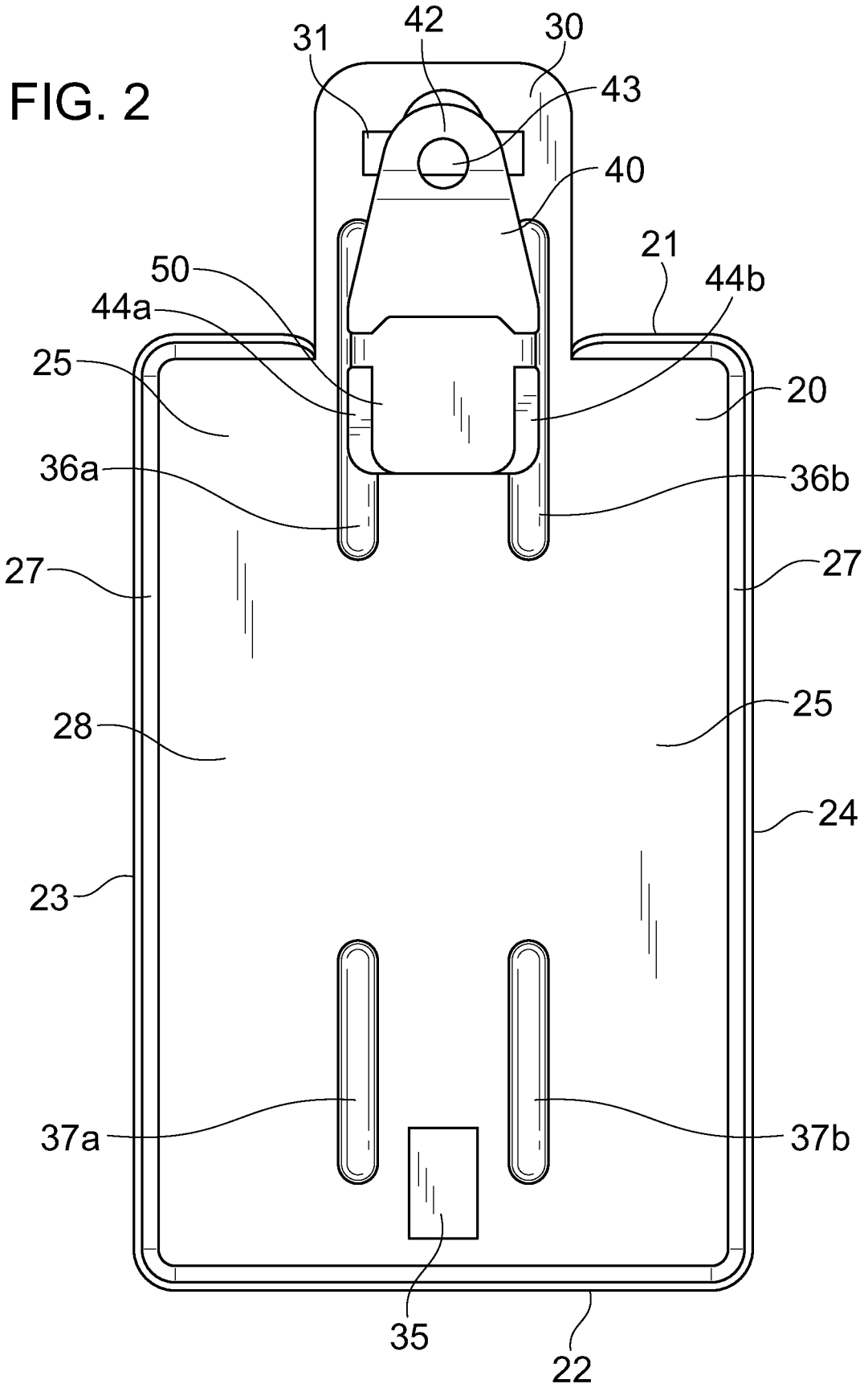
FIG. 2 is a front view of a shielding card holder system in accordance with an example embodiment.
Figure 3:
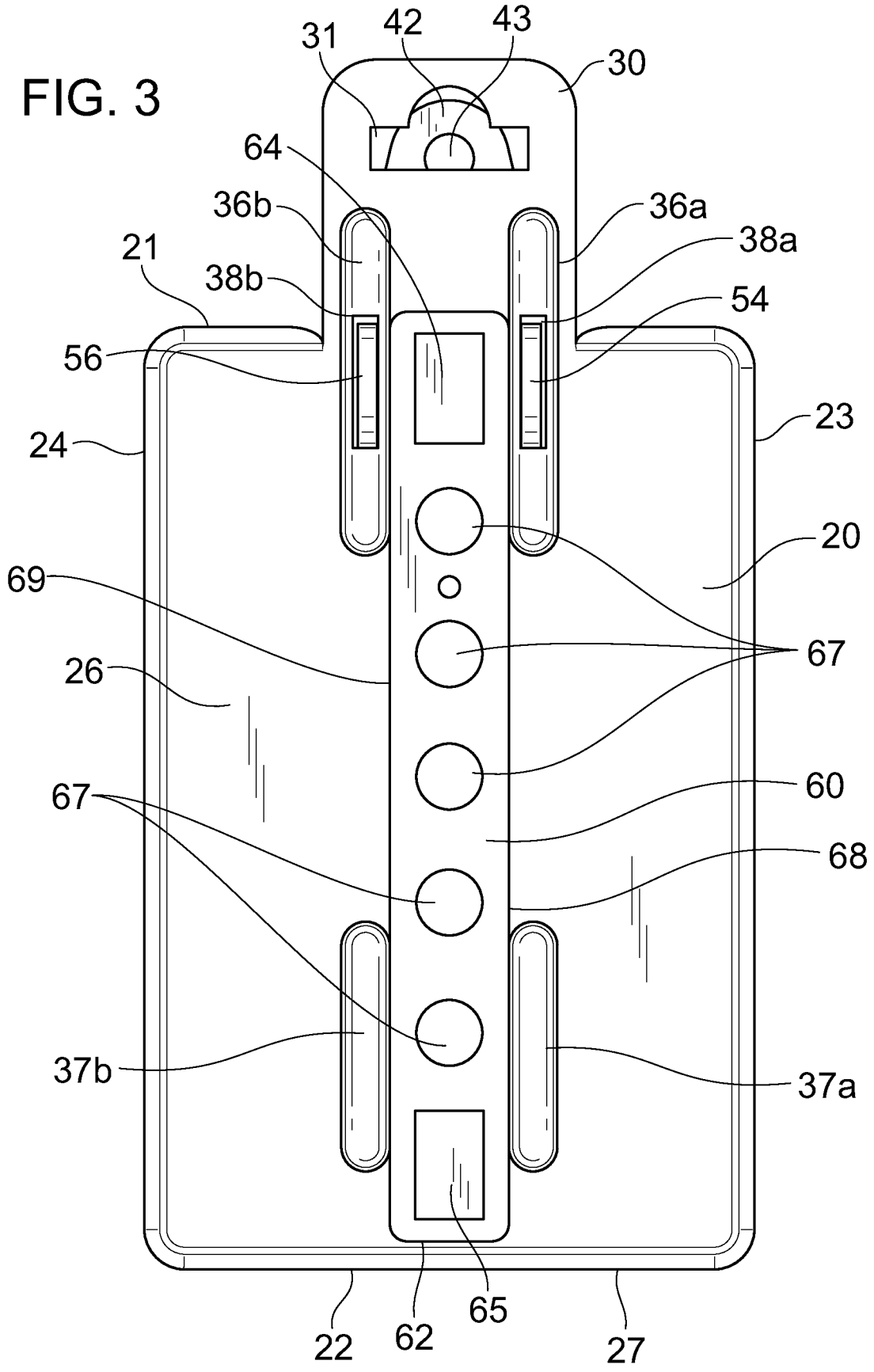
FIG. 3 is a rear view of a shielding card holder system in accordance with an example embodiment.
Figure 4A:
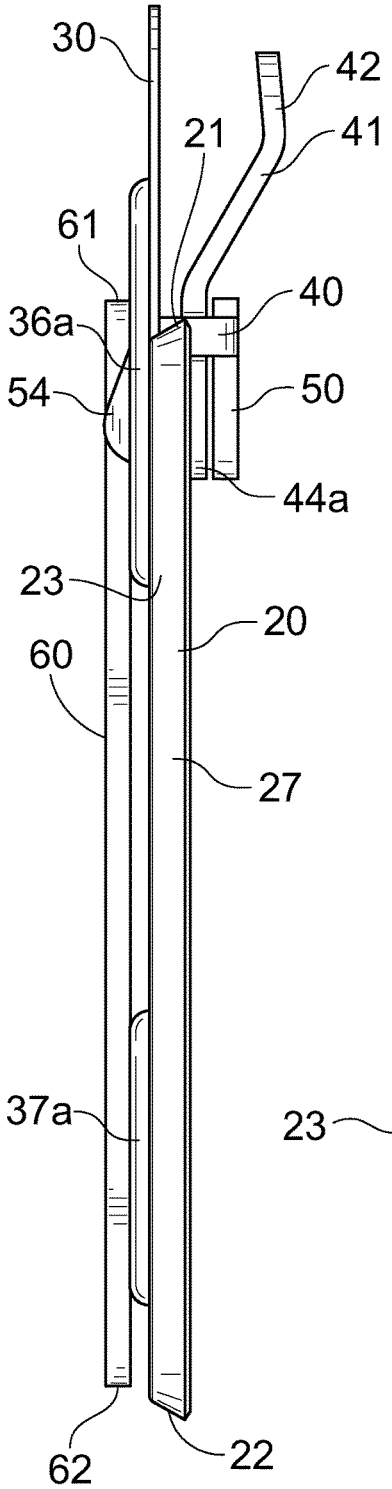
FIG. 4A is a side view of a shielding card holder system in accordance with an example embodiment.
Figure 4B:
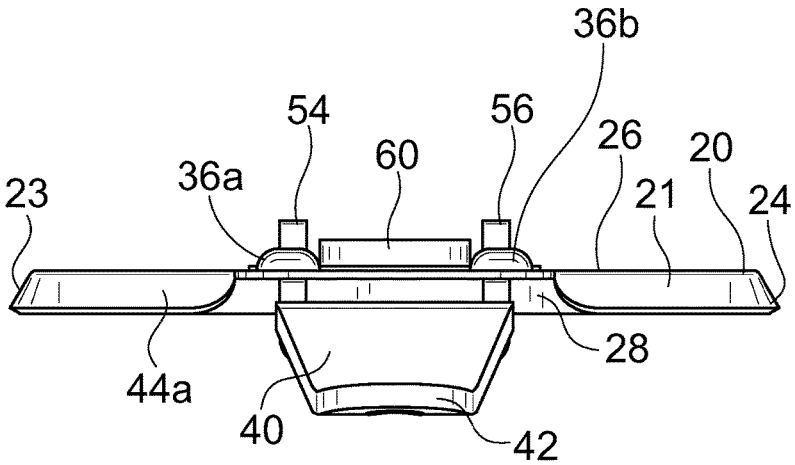
FIG. 4B is a top view of a shielding card holder system in accordance with an example embodiment.
Figure 4C:
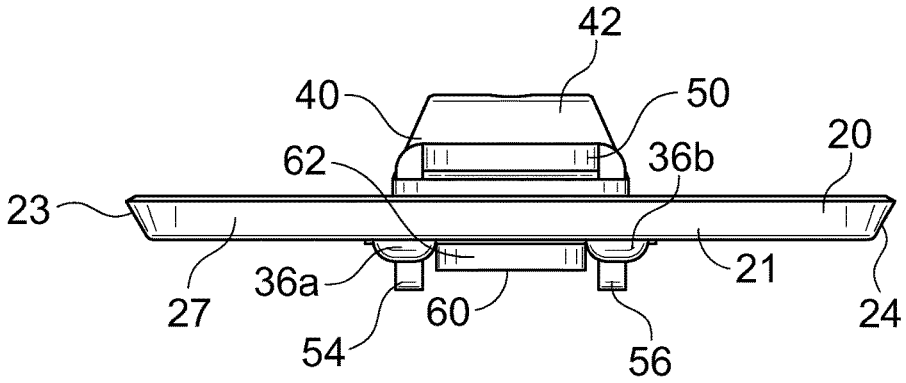
FIG. 4C is a bottom view of a shielding card holder system in accordance with an example embodiment.
Figure 15:
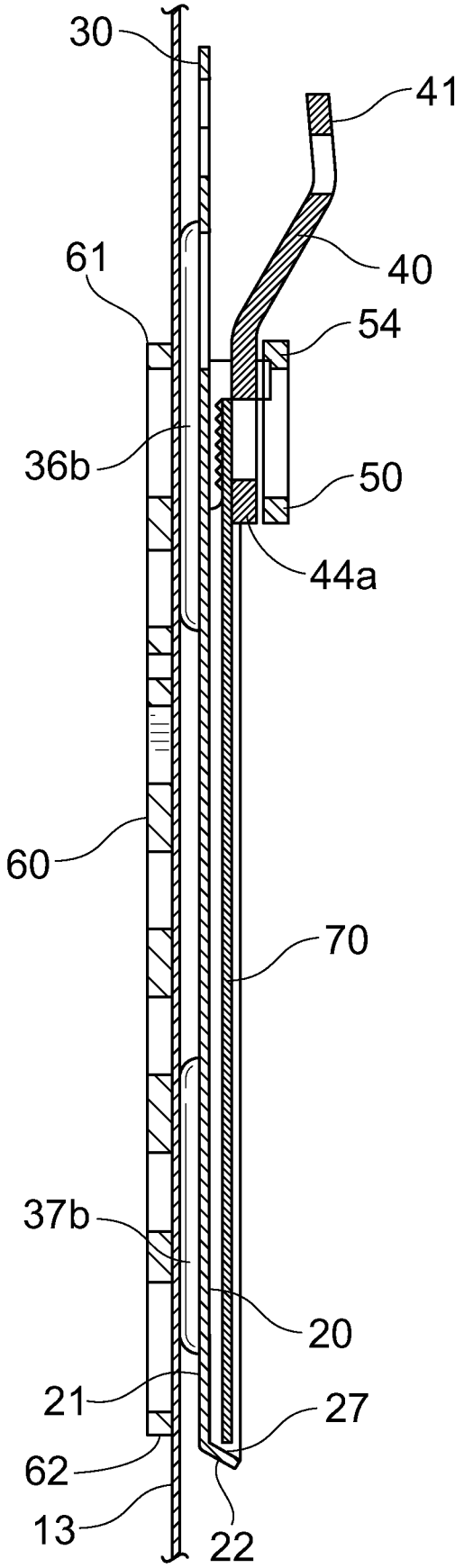
FIG. 15 is a side sectional view of a shielding card holder system in accordance with an example embodiment.

In the embodiment best shown in FIGS. 1-3, the card protector 20 is illustrated as comprising an upper end 21, a lower end 22, a first side 23, a second side 24, an outer surface 25, and an inner surface 26. The card protector 20 may include an outer flange 27 which extends at least partially along the outer perimeter or edge of the card protector 20 such as shown in FIG. 1. The depth of the outer flange 27 may vary, but will preferably be sufficient to cover the outer edge of the card 70 as shown in FIGS. 1 and 15. In this manner, the card 70 may be shielded from unauthorized intrusion such as replication.

The outer flange 27 may include breaks along its length to accommodate the card holder 40. In some embodiments, the outer flange 27 may only be included on portions of the card protector 20. For example, only the corners of the card protector 20 may include an outer flange 27 in some embodiments. As a further example, only the sides 23, 24 of the card protector 20 may include an outer flange 27 in certain embodiments. The outer flange 27 may function to center and retain the card 70 within the card holding space 28 of the card protector 20. In some embodiments, the outer flange 27 may be omitted entirely.

With reference to FIG. 1, it can be seen that the outer flange 27 defines a card holding space 28 within which the card 70 may be secured, with at least a portion of the back side of the card 70 being positioned against or near the outer surface 25 of the card protector 20. The inner surface 26 of the card protector 20 may be secured against an article of clothing 13 such as a shirt, pants, belt, jacket, or the like by operation of the securing member 60 as shown in FIGS. 16-20.

As shown in FIGS. 1-3, 4A, 4B, and 4C, the card protector 20 may include an extended portion 30 such as a tab or other type of projection which extends outwardly from the upper end 21, lower end 22, first side 23, and/or second side 24 of the card protector 20. The extended portion 30 is illustrated as extending from the upper end 21 of the card protector 20 in the embodiments shown in FIGS. 1-3, 4A, 4B, and 4C, but in alternate embodiments, the extended portion 30 may instead extend from one of the two sides 23, 24 of the card protector 20, or from the lower end 22 of the card protector 20. The extended portion 30 may function as a handle for the card protector 20.

With reference to FIG. 1, it can be seen that the extended portion 30 of the card protector 20 may comprise an opening 31 which may be utilized in wearing the card protector 20 as discussed below. The shape, size, and positioning of the opening 31 may vary in different embodiments. In the exemplary embodiments shown in the figures, the opening 31 is illustrated as comprising a keyhole shape.

The card protector 20 will generally include one or more protector magnets 33, 35 which are utilized to removably secure the card holder 40 and/or the securing member 60 to the card protector 20. In some embodiments, the protector magnets 33, 35 may be fixedly connected or integral with the card protector 20. In embodiments such as shown in FIGS. 5A and 5B, the protector magnets 33, 35 may be removably connected to the card protector 20.

The card protector 20 may include magnet openings 32, 34 in which the protector magnets 33, 35 may be secured such that the protector magnets 33, 35 may be flush or depressed with respect to the outer surface 25 of the card protector 20. In some embodiments, the protector magnets 33, 35 may instead extend at least partially outwardly from the outer surface 25 of the card protector 20. In some embodiments, the protector magnets 33, 35 may be secured against the outer surface 25 of the card protector 20 without use of any magnet openings 32, 34, such as by use of a fastener or adhesive.

Figure 5A:
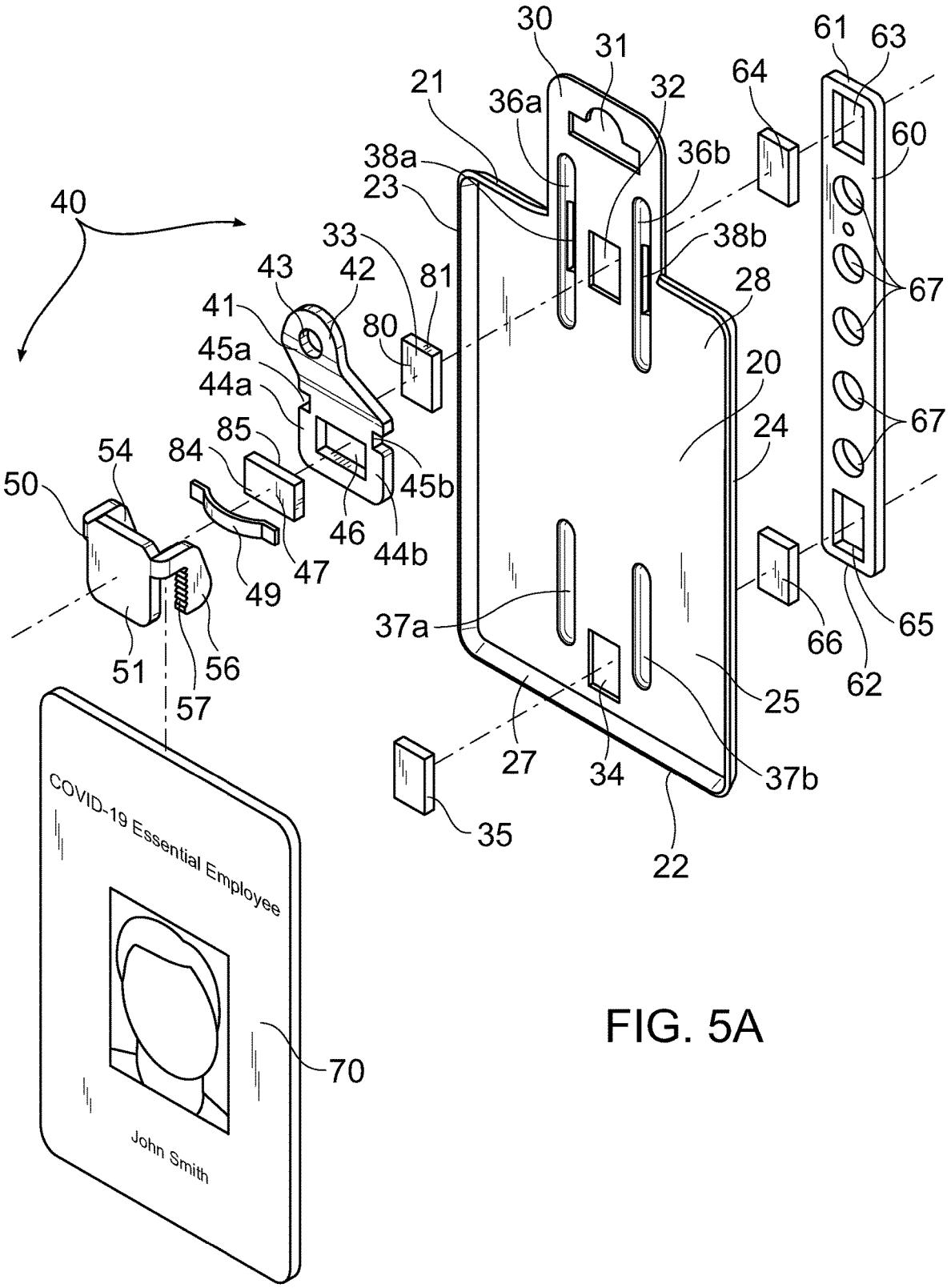
FIG. 5A is an exploded view of a shielding card holder system utilizing a bias member in accordance with an example embodiment.
Figure 5B:
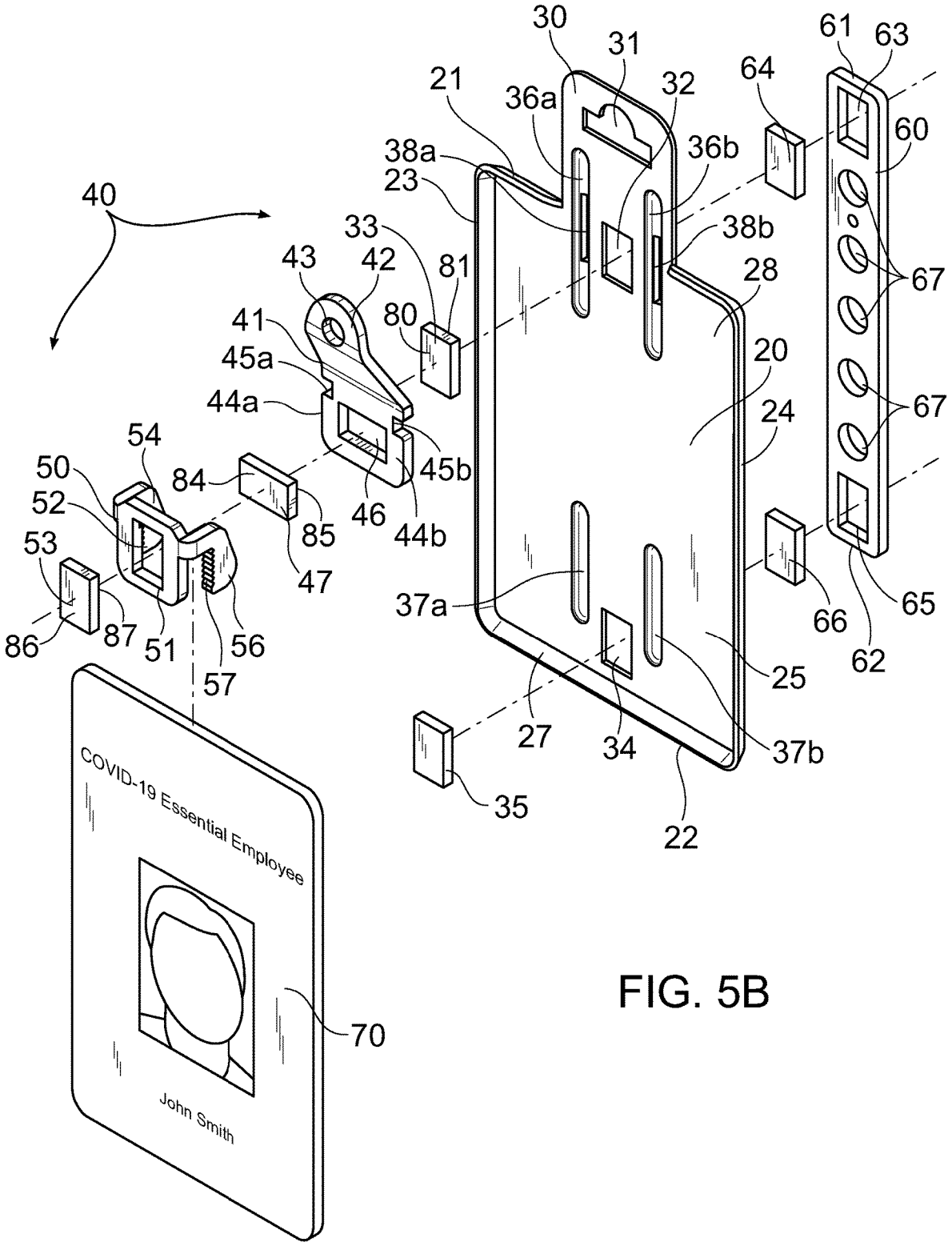
FIG. 5B is an exploded view of a shielding card holder system utilizing a holder magnet in accordance with an example embodiment.

In the embodiment shown in FIGS. 5A and 5B, it can be seen that the card protector 20 may comprise a first magnet opening 32 and a second magnet opening 34, with the first magnet opening 32 being positioned near the upper end 21 of the card protector 20 and the second magnet opening 34 being positioned near the lower end 22 of the card protector 20. It should be appreciated that the positioning of the magnet openings 32, 34 and that of the protector magnets 33, 35 may vary in different embodiments and thus should not be construed as limited by the exemplary embodiments shown in the figures.

Continuing to reference FIGS. 5A and 5B, it can be seen that a first protector magnet 33 may be connected to the card protector 20 near the upper end 21 of the card protector 20 and a second protector magnet 35 may be connected to the card protector 20 near the lower end 22 of the card protector 20. The positioning and number of protector magnets 33, 35 utilized may vary in different embodiments. In some embodiments, more or less protector magnets 33, 35 may be utilized than are shown in the exemplary figures.

The type, strength, and polarization of the protector magnets 33, 35 may vary in different embodiments. The protector magnets 33, 35 will generally comprise permanent (as opposed to temporary) magnets such as but not limited to neodymium iron boron, samarium cobalt, alnico, ceramic, and ferrite magnets. In some embodiments, electromagnets may be utilized.

The shape of the protector magnets 33, 35 may vary in different embodiments. In the embodiment shown in the figures, each of the protector magnets 33, 35 is illustrated as comprising a rectangular shape. It should be appreciated that various other shapes may be utilized for the protector magnets 33, 35, and thus the rectangular shape, including dimensions, shown in the figures should not be construed as limiting.

Figure 7:
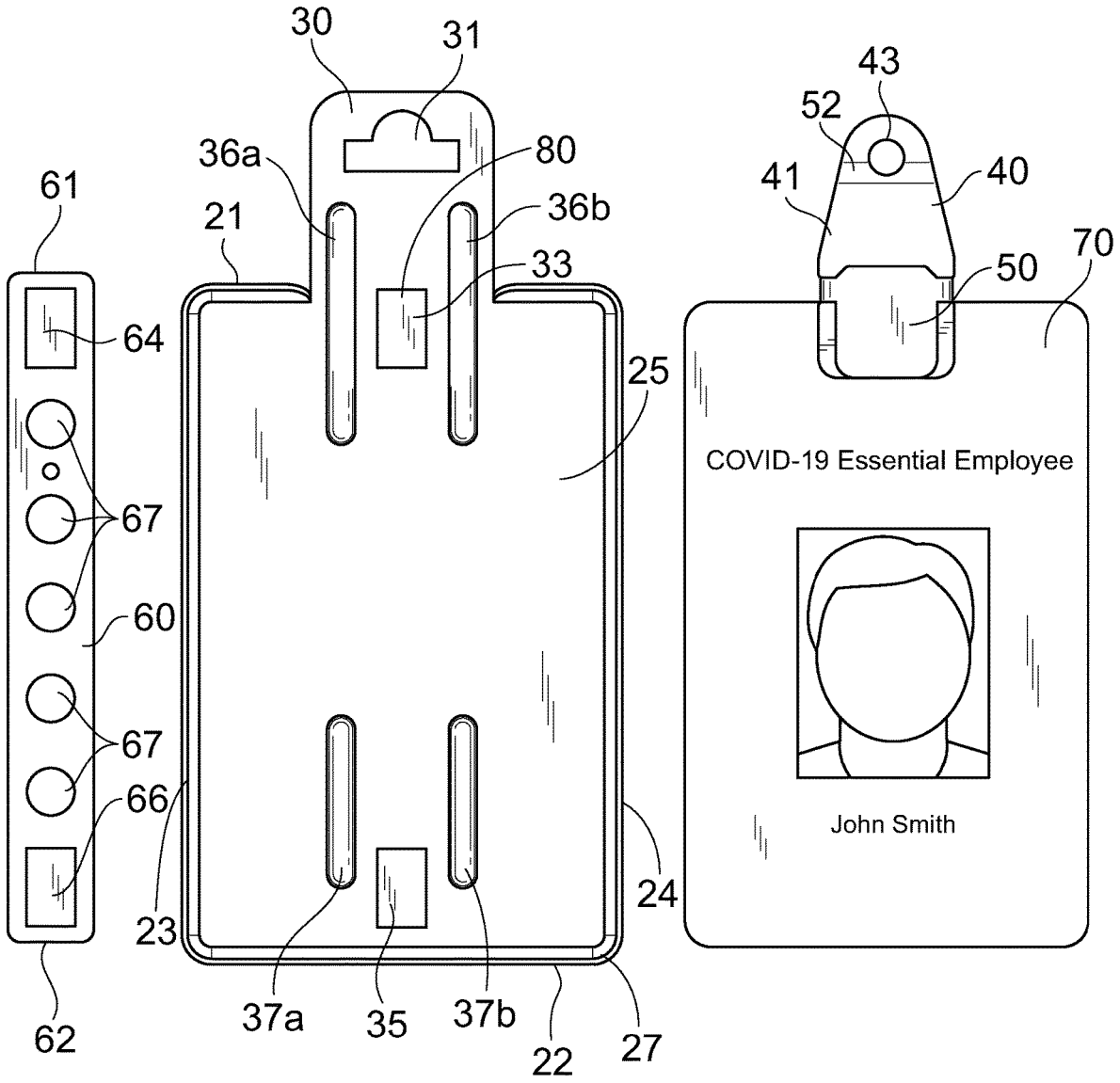
FIG. 7 is a front view of a shielding card holder system in which the card protector, card holder, and securing member have been separated in accordance with an example embodiment.
Figure 8:
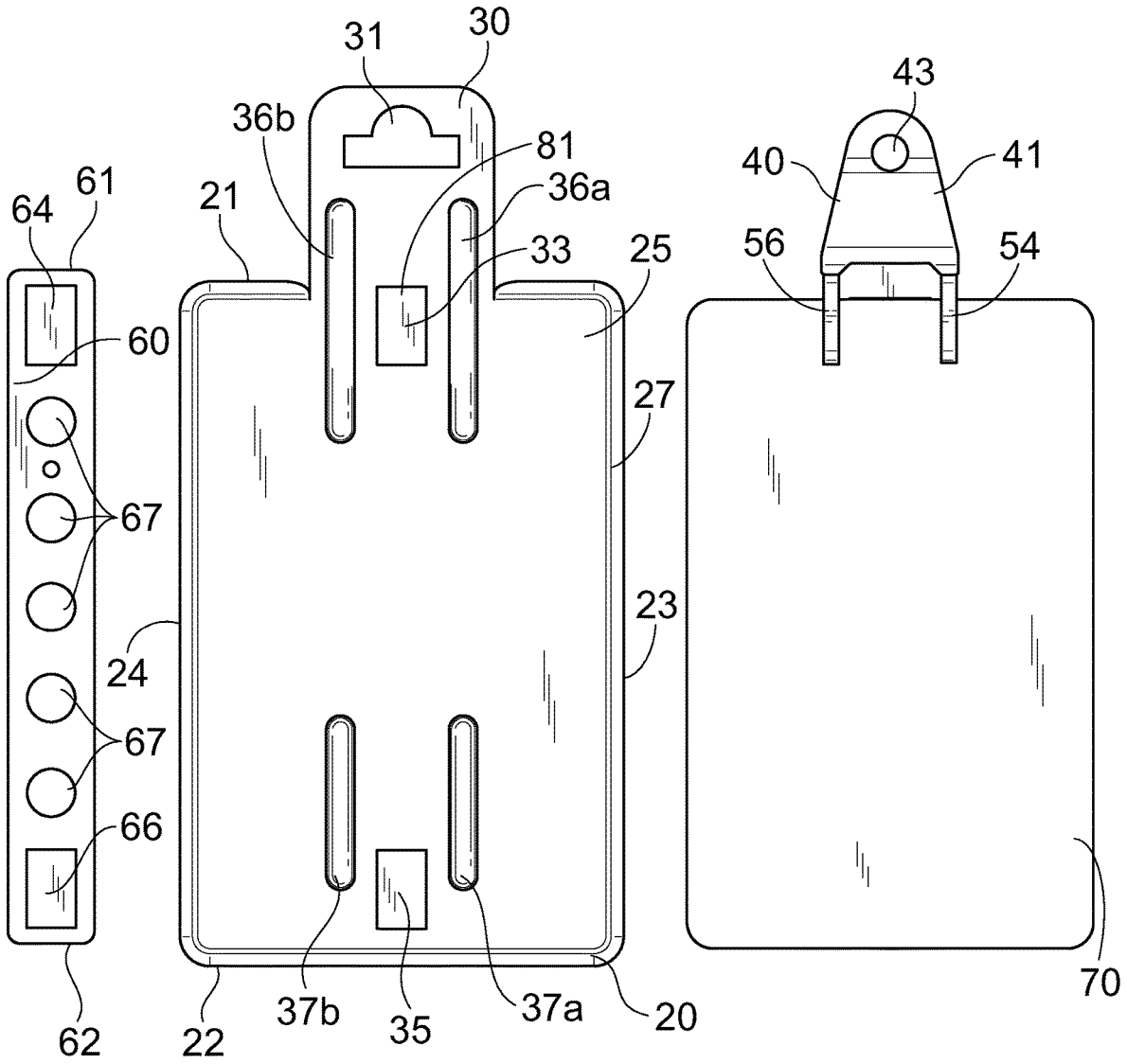
FIG. 8 is a rear view of a shielding card holder system in which the card protector, card holder, and securing member have been separated in accordance with an example embodiment.

With reference to FIGS. 7 and 8, it can be seen that the card protector 20 includes a first protector magnet 33 and a second protector magnet 35. In the upright orientation shown in FIG. 7, the first protector magnet 33 comprises an upper magnet and the second protector magnet 35 comprises a lower magnet, with the first protector magnet 33 being positioned near the upper end 21 of the card protector 20 and the second protector magnet 35 being positioned near the lower end 22 of the card protector 20.

It should be appreciated that, in some embodiments, the first and second protector magnets 33, 35 may not be positioned near the upper and lower ends 21, 22 of the card protector 20. For example, in some embodiments, the first protector magnet 33 may be positioned near the first side 23 of the card protector 20 and the second protector magnet 35 may be positioned near the second side 24 of the card protector 20. The card protector 20 may also be rotated in orientation, such as rotated into a horizontal orientation (as opposed to the vertical orientation shown in the figures), such that the protector magnets 33, 35 are oriented horizontally rather than vertically.

Figure 6:
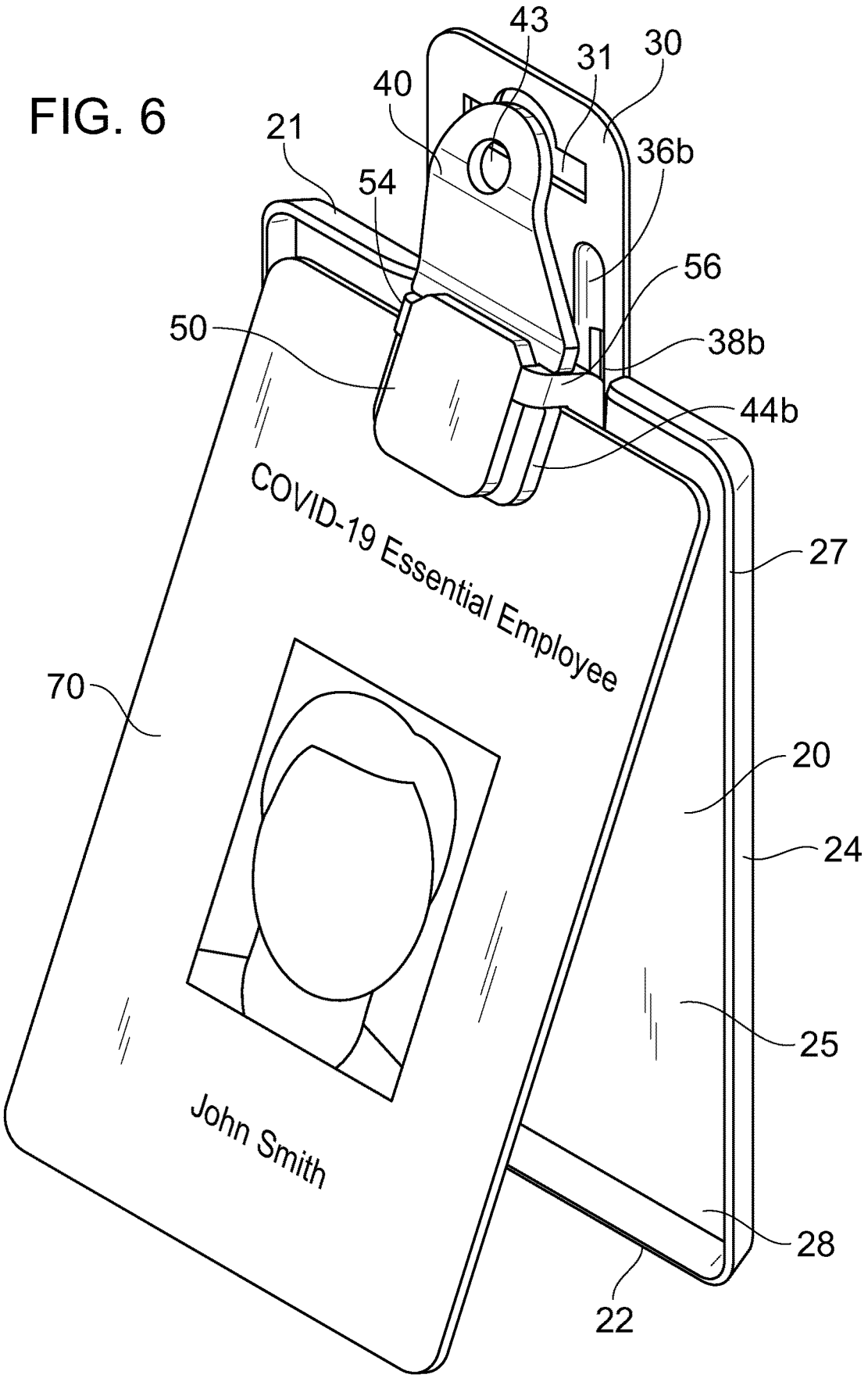
FIG. 6 is a perspective view of a shielding card holder system with the card holder and card pivoted outwardly in accordance with an example embodiment.

The first protector magnet 33 may be utilized to removably attach the card holder 40 to the card protector 20 such as shown in FIGS. 1, 2, and 6. The first protector magnet 33 may thus include a first surface 80 such as an outer surface and a second surface 81 which is opposite to the first surface 80, such as an inner surface. The polarity of the first surface 80 of the first protector magnet 33 will generally be opposite to the polarity of the second surface 85 of the first holder magnet 47 such that the inner surface of the first holder magnet 47 is attracted to the first surface 80 of the first protector magnet 33 to removably secure the card holder 40 against the card protector 20 by magnetic attraction between the first protector magnet 33 and the first holder magnet 47.

The first protector magnet 33 may also be utilized to removably couple the securing member 60 to the card protector 20. Thus, the polarity of the second surface 81 of the first protector magnet 33 will generally be opposite to the polarity of the outer surface of the first securing magnet 64 of the securing member 60 such that the outer surface of the first securing magnet 64 is attracted to the second surface 81 of the first protector magnet 33 to removably couple the securing member 60 against the card protector 20 by magnetic attraction between the first protector magnet 33 and the first securing magnet 64.

In the exemplary embodiment shown in the figures, it can be seen that the first surface 80 of the first protector magnet 33 is visible on the outer surface 25 of the card protector 20 and that the second surface 81 of the first protector magnet 33 is visible on the inner surface 26 of the card protector 20. It should be appreciated that, in some embodiments, a pair of first protector magnets 33 may instead be utilized, with a first on the outer surface 25 of the card protector 20 and a second on the inner surface 26 of the card protector 20.

In some embodiments, or depending upon the orientation of the card protector 20, the functions of the first and second protector magnets 33, 35 may be interchangeable. Thus, in some embodiments or orientations, the card holder 40 may be removably attached to the first protector magnet 33. In other embodiments or orientations, the card holder 40 may instead be removably attached to the second protector magnet 35. Thus, the scope should not be construed as limited by the exemplary embodiments shown in the figures in which the card holder 40 is removably attached to the first protector magnet 33, as depending upon the orientation and/or embodiment of the card holder 40, the card holder 40 may instead be removably attached to the second protector magnet 35.

As shown in FIGS. 7 and 8, a second protector magnet 35 may also be integral with or connected to the card protector 20. Generally, the second protector magnet 35 is utilized to secure the securing member 60 against the card protector 20 though, as mentioned herein, the second protector magnet 35 may in some embodiments be utilized to secure the card holder 40. In the embodiment shown in the figures, the polarity of the inner surface of the second protector magnet 35 will preferably be opposite to the polarity of the outer surface of the second securing magnet 66 such that the second securing magnet 66 will be attracted to the second protector magnet 35 for securing the securing member 60 against the card protector 20, either directly or indirectly.

In a preferred embodiment, the polarity of the first protector magnet 33 and the second protector magnet 35 will be reversed with respect to each other. Thus, the first surface 80 of the first protector magnet 33 will be opposite to the same surface of the second protector magnet 35. The use of reverse polarities on the pair of protector magnets 33, 35 ensures that the first holder magnet 47 of the card holder 40 is only attracted to the first protector magnet 33, and not to the second protector magnet 35. Such a configuration prevents the card holder 40 from accidentally magnetically engaging with the second protector magnet 35 rather than the first protector magnet 33.

The second protector magnet 35 will generally be utilized for coupling the securing member 60 to the card protector 20. In the embodiment shown in FIG. 10, it can be seen that both the first and second protector magnets 33, 35 are utilized to secure the securing member 60 against the card protector 20 (with or without a layer of clothing positioned between the card protector 20 and the securing member 60).

However, it should be appreciated that alternate configurations may be utilized. As a first example, the second protector magnet 35 could be omitted entirely; with only a single protector magnet 33 being utilized exclusively to secure both the card holder 40 and the securing member 60 to the card protector 20. As a second example, the first protector magnet 33 may be utilized exclusively for the card holder 40 and the second protector magnet 35 may be utilized exclusively for the securing member 60. As a third example and as shown in the figures, the first protector magnet 33 may be utilized to secure the card holder 40 and both the first and second protector magnets 33, 35 may be utilized in concert to secure the securing member 60.

As best shown in FIGS. 3 and 8, the card protector 20 may include a pair of upper ribs 36*a*, 36*b* and a pair of lower ribs 37*a*, 37*b* which serve as a guide for positioning of the securing member 60 and which aid in securing an article of clothing 13 between the card protector 20 and the securing member 60 as discussed herein. The use of the ribs 36*a*, 36*b*, 37*a*, 37*b* function to prevent the securing member 60 from sliding with respect to the card protector 20, such as side-to-side. Thus, ribs 36*a*, 36*b*, 37*a*, 37*b* create a track within which the securing member 60 may be secured to efficiently attach the card protector 20 to an article of clothing 13.

As best shown in FIGS. 2, 5A, 5B, and 7, the outer surface 25 of the card protector 20 may include depressions which form the upper ribs 36*a*, 36*b* and the lower ribs 37*a*, 37*b*. It can be seen that a first upper rib 36*a* is comprised of a depression in the outer surface 25 of the card protector 20 and that a second upper rib 36*b* is comprised of a depression in the outer surface 25 of the card protector 20. Similarly, a first lower rib 37*a* is comprised of a depression in the outer surface 25 of the card protector 20 and a second lower rib 37*b* is comprised of a depression in the outer surface 25 of the card protector 20. Such a configuration may be the result of stamping the card protector 20 so as to form a depression on the outer surface 25 and a projection on the inner surface 26.

As best shown in FIGS. 3 and 8, the inner surface 26 of the card protector 20 may include projections which form the upper ribs 36*a*, 36*b* and the lower ribs 37*a*, 37*b*. In some embodiments, the upper and lower ribs 36*a*, 36*b*, 37*a*, 37*b* may not form depressions in the outer surface 25 of the card protector 20, and only be comprised of projections from the inner surface 26 of the card protector 20. Thus, rather than the ribs 36*a*, 36*b*, 37*a*, 37*b* being pressed into the outer surface 25 of the card protector 20, they may instead be secured to or integral with the inner surface 26 of the card protector 20.

The shape, size, and configuration of the ribs 36*a*, 36*b*, 37*a*, 37*b* may vary in different embodiments, and thus should not be construed as limited by the exemplary figures. In the figures, it can be seen that the upper ribs 36*a*, 36*b* are each comprised of an elongated rib which are parallel to each other. Similarly, the lower ribs 37*a*, 37*b* are each shown as comprised of parallel elongated ribs. The first upper rib 36*a* is shown as being aligned with and spaced-apart with respect to the first lower rib 37*a*, and the second upper rib 36*b* is shown as being aligned with and spaced-apart with respect to the second lower rib 37*b*.

Aligning the upper and lower ribs 36*a*, 36*b*, 37*a*, 37*b* forms a rectangular track or guide for the securing member 60 to fit within. It should be appreciated that the spacing, dimensions, positioning, and orientation of the ribs 36*a*, 36*b*, 37*a*, 37*b* may vary depending upon the shape and size of the securing member 60. In some embodiments, only a single upper rib 36*a* and a single lower rib 37*a* may be utilized, such as for example with embodiments in which the securing member 60 is shorter in length than the embodiment shown in the figures.

As best shown in FIGS. 3, 5A, and 5B, the card protector 20 may comprise a pair of holder openings 38*a*, 38*b* in which the card holder 40 may pivot when in use. The holder openings 38*a*, 38*b* may be formed within the upper or lower ribs 36*a*, 36*b*, 37*a*, 37*b*. In the embodiment shown in the figures, the first upper rib 36*a* includes a first holder opening 38*a* and the second upper rib 36*b* includes a second holder opening 38*b*. In alternate embodiments, the holder openings 38*a*, 38*b* may instead be positioned within the lower ribs 37*a*, 37*b*. In yet other embodiments, the holder openings 38*a*, 38*b* may be independent of any ribs 36*a*, 36*b*, 37*a*, 37*b*.

The shape and size of the holder openings 38*a*, 38*b* may vary in different embodiments. In the exemplary embodiment shown in the figures, the holder openings 38*a*, 38*b* are each illustrated as comprising vertically-oriented elongated openings. In some embodiments, the holder openings 38*a*, 38*b* may instead be horizontally-oriented or diagonally-oriented. Further, the positioning of the holder openings 38*a*, 38*b* may vary depending upon the embodiment of the card protector 20 and/or card holder 40. Additionally, the length and overall dimensions of the holder openings 38*a*, 38*b* may vary and should not be construed as limited by the exemplary embodiment shown in the figures.

C. Card Holder

As shown throughout the figures, a card holder 40 may be removably connected to the card protector 20 via magnetic attraction. The card holder 40 is utilized to retain a card 70 such as a credit card, identification card, an RFID badge or the like of varying thicknesses. It should be appreciated that a wide range of types of cards 70 may be utilized in connection with the systems and methods described herein. Thus, the scope should not be construed as limiting to any particular type of card 70 with any particular type of functionality. Generally, the card 70 will first be secured within the card holder 40, and then the card holder 40 will be secured to the card protector 20. However, in some embodiments, the card holder 40 may instead be first connected to the card protector 20 prior to inserting the card 70 into the card holder 40.

Figure 12A:
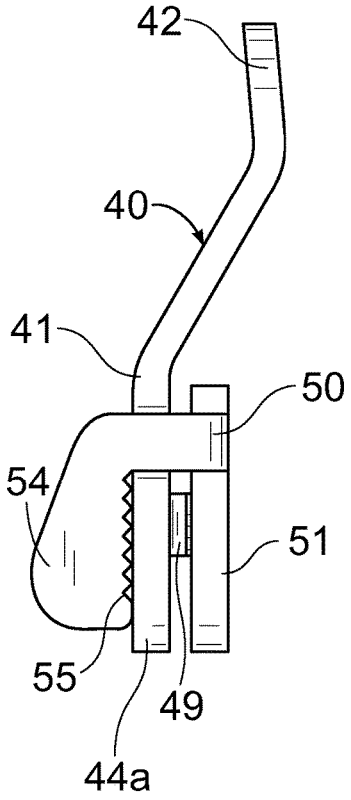
FIG. 12A is a side view of a card holder in the closed position of a shielding card holder system in accordance with an example embodiment.
Figure 12B:
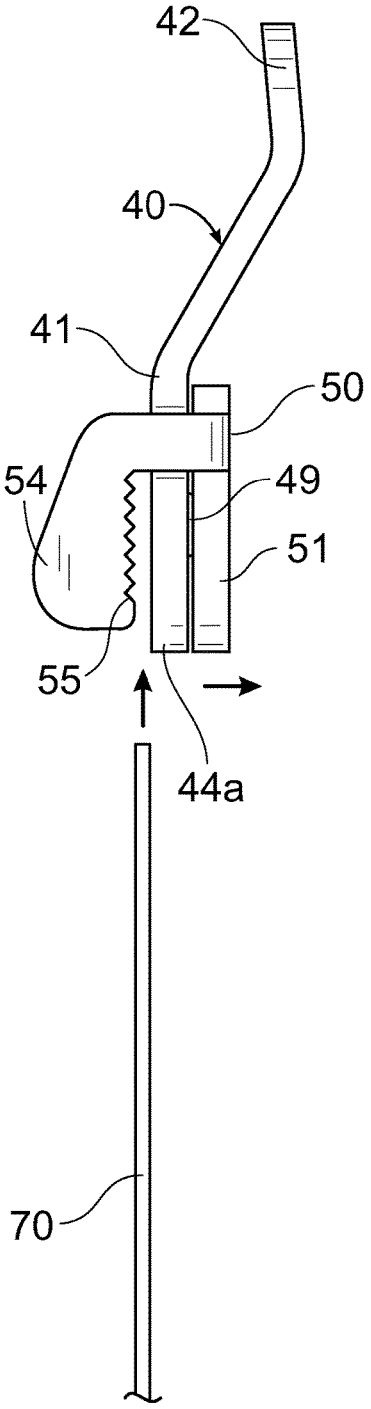
FIG. 12B is a side view of a card holder in the opened position with a card aligned for insertion of a shielding card holder system in accordance with an example embodiment.
Figure 12C:
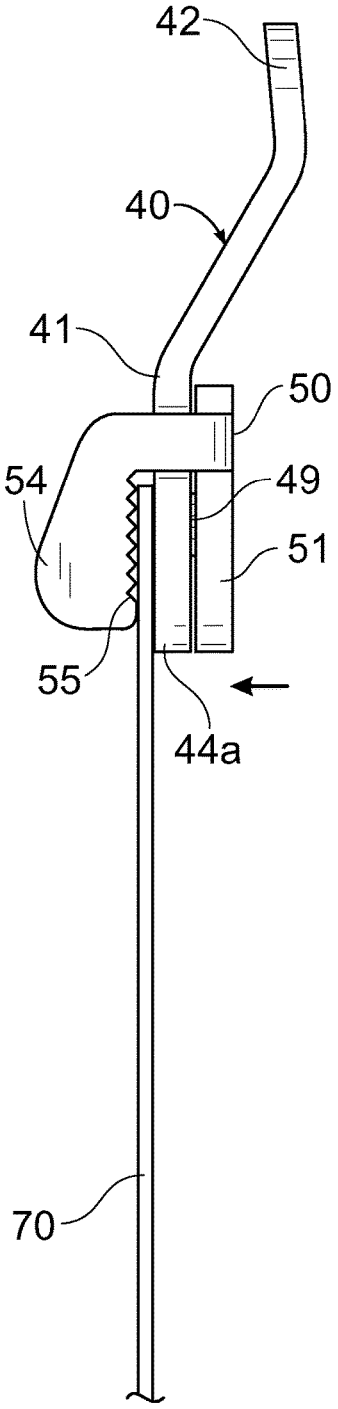
FIG. 12C is a side view of a card holder in the closed position with a card inserted of a shielding card holder system in accordance with an example embodiment.
Figure 13A:
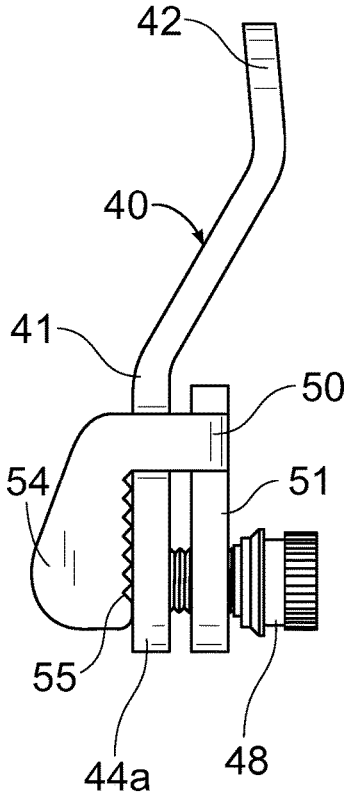
FIG. 13A is a side view of a card holder in the closed position of a shielding card holder system in accordance with an example embodiment.
Figure 13B:
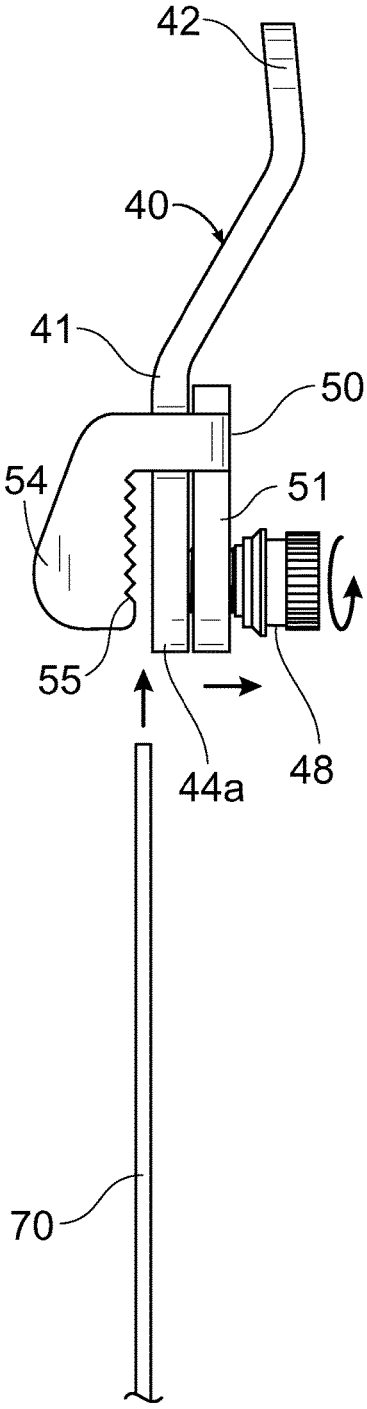
FIG. 13B is a side view of a card holder in the opened position with a card aligned for insertion of a shielding card holder system in accordance with an example embodiment.

The card holder 40 is generally adjustable between an opened position, such as shown in FIGS. 12B and 13B, and a closed position, such as shown in FIGS. 12A, 12C, 13A, and 13C. In the opened position, the card holder 40 allows for insertion of a card 70 to be retained in the card holder 40. In the closed position, the card holder 40 holds the card 70 until such time as the card 70 is removed. The card holder 40 is adapted to hold cards 70 of varying thicknesses, ranging from thinner cards 70 such as credit cards to thicker cards 70 such as badges. It should be appreciated from viewing the embodiments of the card holder 40 shown in the figures that, in the closed position, portions of the first member 41 may be drawn away from the second member 50 such that the projections 44*a*, 44*b* of the first member 41 are drawn towards the arms 54, 56 of the second member 50. Conversely, in the opened position, portions of the first member 41 may be drawn towards the second member 50 such that the projections 44*a*, 44*b* of the first member 41 are drawn away from the arms 54, 56 of the second member 50. Thus, when the card holder 40 is in its opened position, there is a space between the first projection 44*a* and the first arm 54 and a space between the second projection 44*b* and the second arm 56. When the card holder 40 is in its closed position, the first projection 44*a* is positioned against the first arm 54 and the second projection 44*b* is positioned against the second arm 56.

Figure 13C:
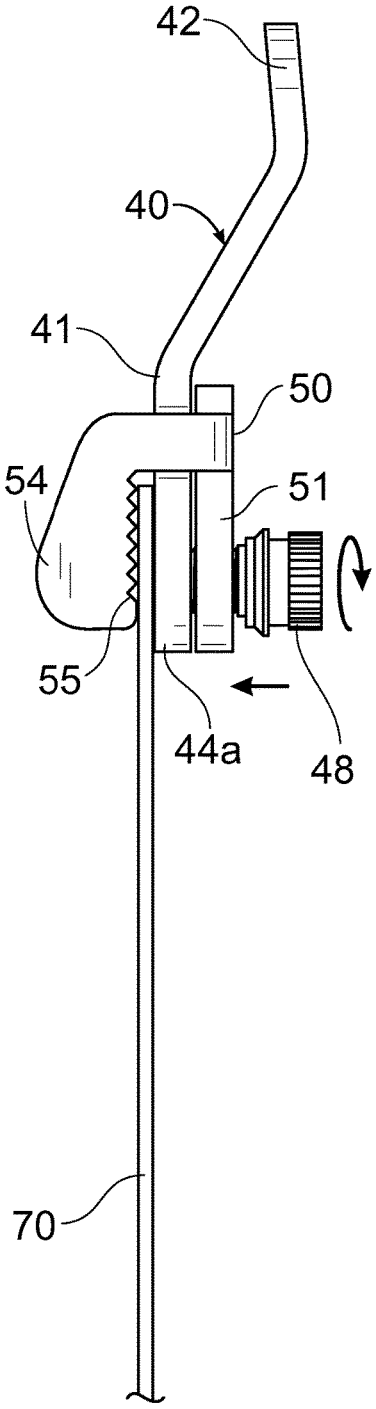
FIG. 13C is a side view of a card holder in the closed position with a card inserted of a shielding card holder system in accordance with an example embodiment.

The card holder 40 may be biased towards the closed position, such as through use of a bias member 49. In one exemplary embodiment such as shown in FIG. 5B, a pair of holder magnets 47, 53 may be utilized to magnetically bias the card holder 40 towards the closed position. The manner in which the card holder 40 is adjustable between the opened and closed positions may vary. In another exemplary embodiment such as shown in FIGS. 13A, 13B, and 13C, a fastener 48 such as a screw may be utilized to open and close the card holder 40.

The card holder 40 may comprise a clamp. FIGS. 5A and 5B illustrate an exploded view of the card holder 40 in which it can be seen that the card holder 40 comprises a first member 41 and a second member 50, with the first member 41 being movably connected to the second member 50. The first and second members 41, 50 are configured such that the card 70 is secured to the card holder 40 by being pressed or sandwiched between the respective first and second members 41, 50 of the card holder 40.

As best shown in FIGS. 12A, 12B, and 12C, the first member 41 of the card holder 40 may be biased towards the second member 50 of the card holder 40 such that, absent application of force, the projections 44*a*, 44*b* of the first member 41 are positioned against the arms 54, 56 of the second member 50 of the card holder 40 so as to retain a card 70 between the first and second members 41, 50. With application of force, the projections 44*a*, 44*b* of the first member 41 and the arms 54, 56 of the second member 50 may be slightly separated so that a card 70 may be inserted into or removed from the card holder 40. Upon cessation of the application of force, the first and second members 41, 50 revert back to their natural position in which they are pressed together.

The first member 41 may include a handle 42 which may be primarily utilized to grasp the card holder 40 when the card holder 40 is being removed from or attached to the card protector 20. The handle 42 may also be utilized when pivoting the card holder 40 so as to pivot the card 70 away from the card protector 20 such that the card 70 may be scanned without fully removing the card holder 40 from the card protector 20. In some embodiments, the handle 42 may also be utilized to open or close the card holder 40 by pivoting the first member 41 either towards or away from the second member 50.

The shape, size, and orientation of the handle 42 may vary in different embodiments. In the embodiment shown in the figures, the handle 42 may comprise an angular tab-like structure which extends outwardly from the first member 41. The handle 42 may include an opening 43 which is utilized for securing the card holder 40 to various devices, such as a strap 14 or extension reel 16 as discussed below.

As shown in FIGS. 5A and 5B, the main body of the first member 41 may comprise a substantially rectangular shape, with the handle 42 extending outwardly from the main body. The first member 41 generally includes a pair of projections 44*a*, 44*b* which extend outwardly from the sides of its main body. These projections 44*a*, 44*b* function in concert with the arms 54, 56 of the second member 50 to secure the card 70 in the card holder 40.

Continuing to reference FIGS. 5A and 5B, it can be seen that a first projection 44*a* extends outwardly in a first direction from a first side of the first member 41 of the card holder 40 and that a second projection 44*b* extends outwardly in a second direction from a second side of the first member 41 of the card holder 40. A pair of depressions 45*a*, 45*b* are defined between the projections 44*a*, 44*b* and the handle 42, with a first depression 45*a* defined between the first projection 44*a* and the handle 42 and a second depression 45*b* defined between the second projection 44*b* and the handle 42. Portions of the arms 54, 56 of the second member 50 may rest within these depressions 45*a*, 45*b* as discussed in more detail below.

As shown in FIGS. 5A and 5B, it can be seen that the first member 41 of the card holder 40 may include a magnet opening 46 in which a first holder magnet 47 may be secured. It should be appreciated that the first holder magnet 47 may be removably connected within the magnet opening 46, or may be fixedly connected. In some embodiments, the first holder magnet 47 may be integral with the first member 41 of the card holder 40. The shape and size of the magnet opening 46 may vary depending upon the shape and size of the first holder magnet 47. In some embodiments, the magnet opening 46 may be omitted, with the first holder magnet 47 being instead attached to the surface of the first member 41. Thus, the first holder magnet 47 may be flush with the first member 41, may extend out past the first member 41, or may be depressed with respect to the first member 41.

The type, strength, and polarization of the first holder magnet 47 may vary in different embodiments. The first holder magnet 47 may comprise a first surface 84 such as an outer surface and a second surface 85 opposite to the first surface 84, such as an inner surface. The first holder magnet 47 may have a first polarity on the first surface 84 and a second polarity on the second surface 85. The first holder magnet 47 will generally comprise a permanent (as opposed to temporary) magnet such as but not limited to neodymium iron boron, samarium cobalt, alnico, ceramic, and ferrite magnets. In some embodiments, electromagnets may be utilized.

In some embodiments, the card holder 40, including the first member 41 and/or the second member 50, may instead be comprised of a magnetically-attractive material. In such embodiments, the first holder magnet 47 may be omitted, with the card holder 40 itself being magnetically-attracted to the first protector magnet 33 of the card protector 20 for removably attaching the card holder 40 to the card protector 20. In such embodiments, at least a portion of the card holder 40 may be comprised of a magnetically-attractive material. For example, the first member 41 in such embodiments may be comprised of a magnetically-attractive material which is adapted to magnetically engage with the first protector magnet 33 of the card protector 20.

The shape of the first holder magnet 47 may vary in different embodiments. In the embodiment shown in the figures, the first holder magnet 47 is illustrated as comprising a rectangular shape. It should be appreciated that various other shapes may be utilized for the first holder magnet 47, and thus the rectangular shape, including dimensions, shown in the figures should not be construed as limiting. The positioning and orientation of the first holder magnet 47 on the first member 41 of the card holder 40 may also vary and should not be construed as limited by the exemplary figures.

Figure 9:
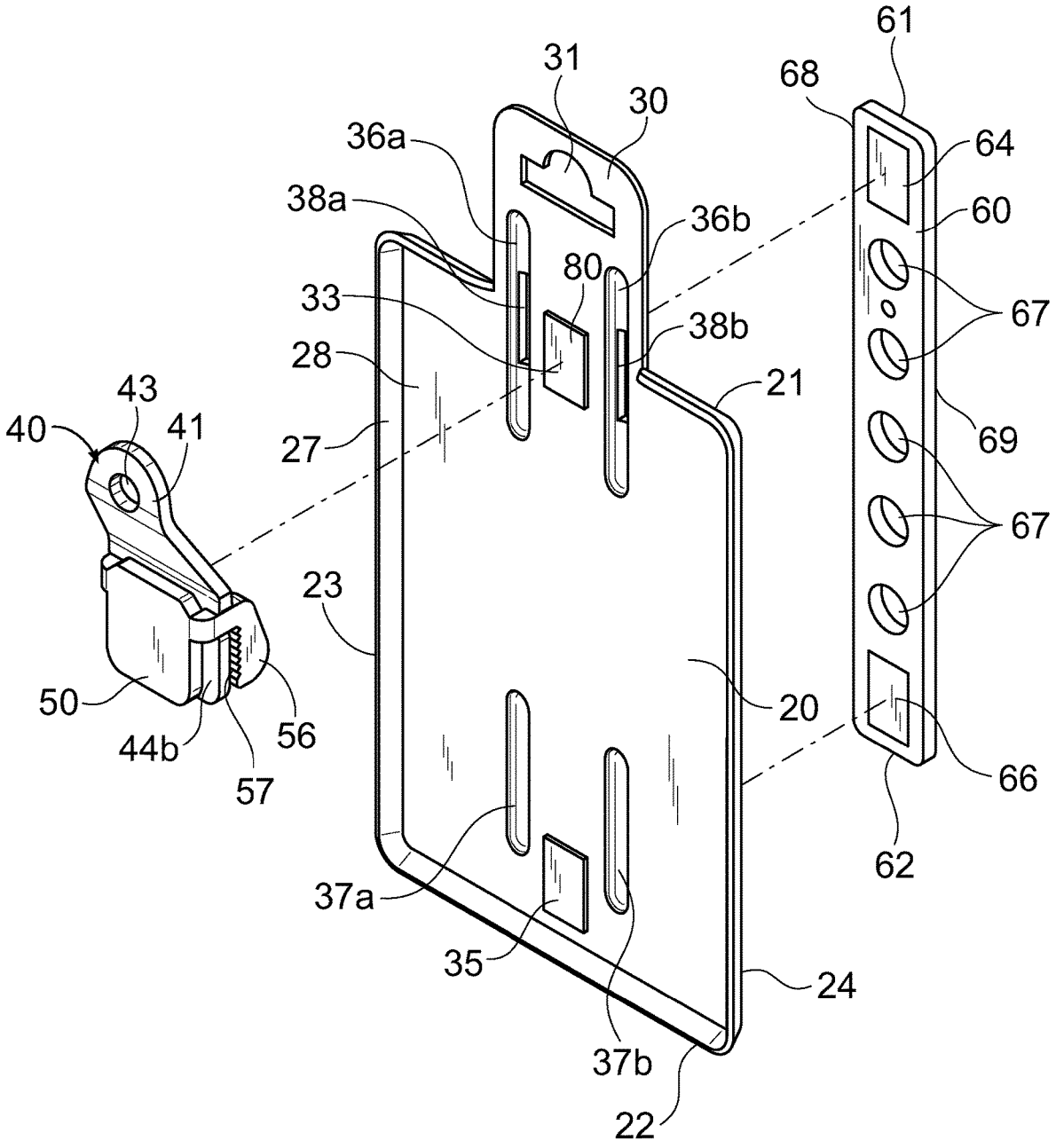
FIG. 9 is a front perspective view of a shielding card holder system in which the card protector, card holder, and securing member have been separated in accordance with an example embodiment.
Figure 10:
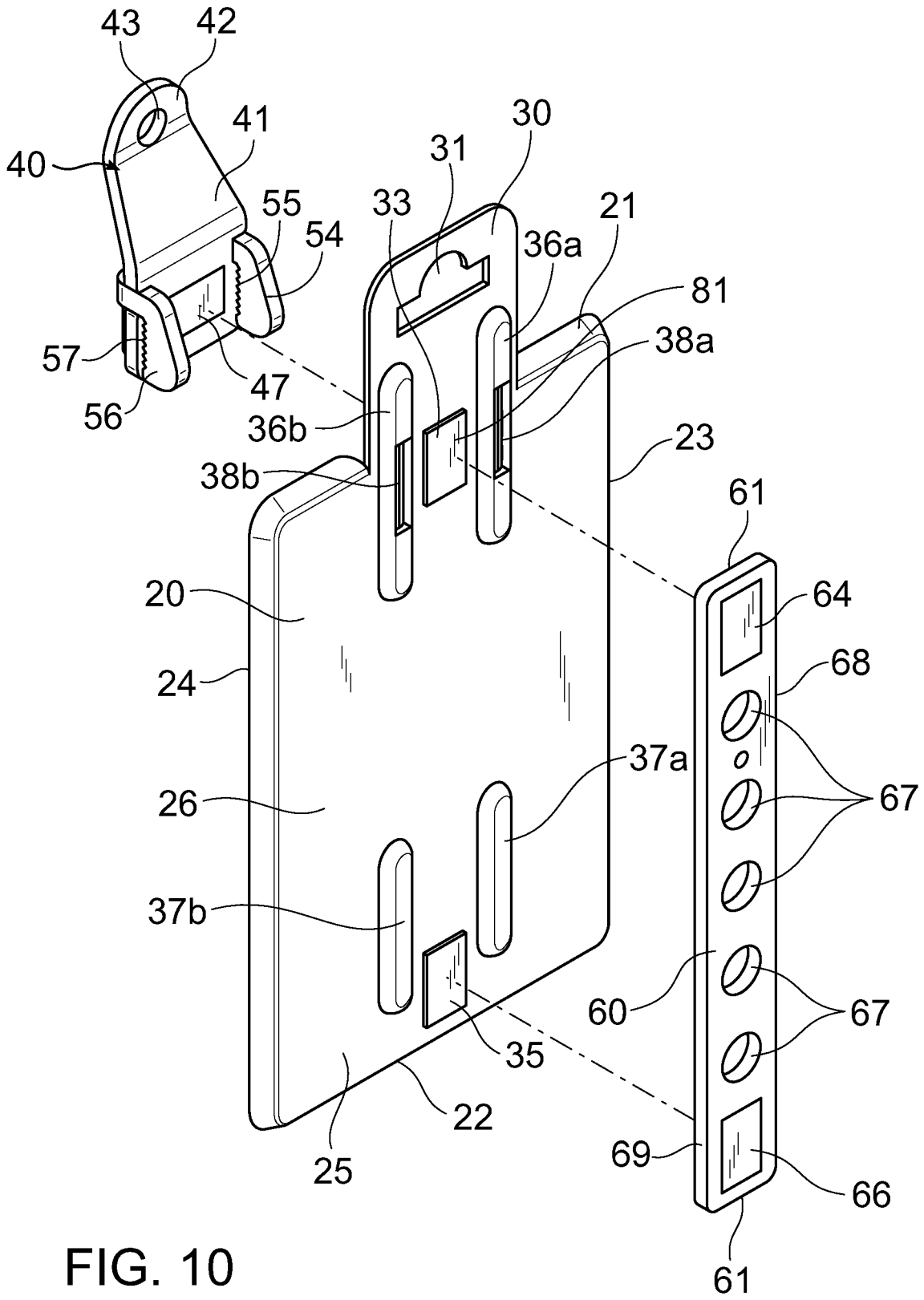
FIG. 10 is a rear perspective view of a shielding card holder system in which the card protector, card holder, and securing member have been separated in accordance with an example embodiment.
Figure 11:
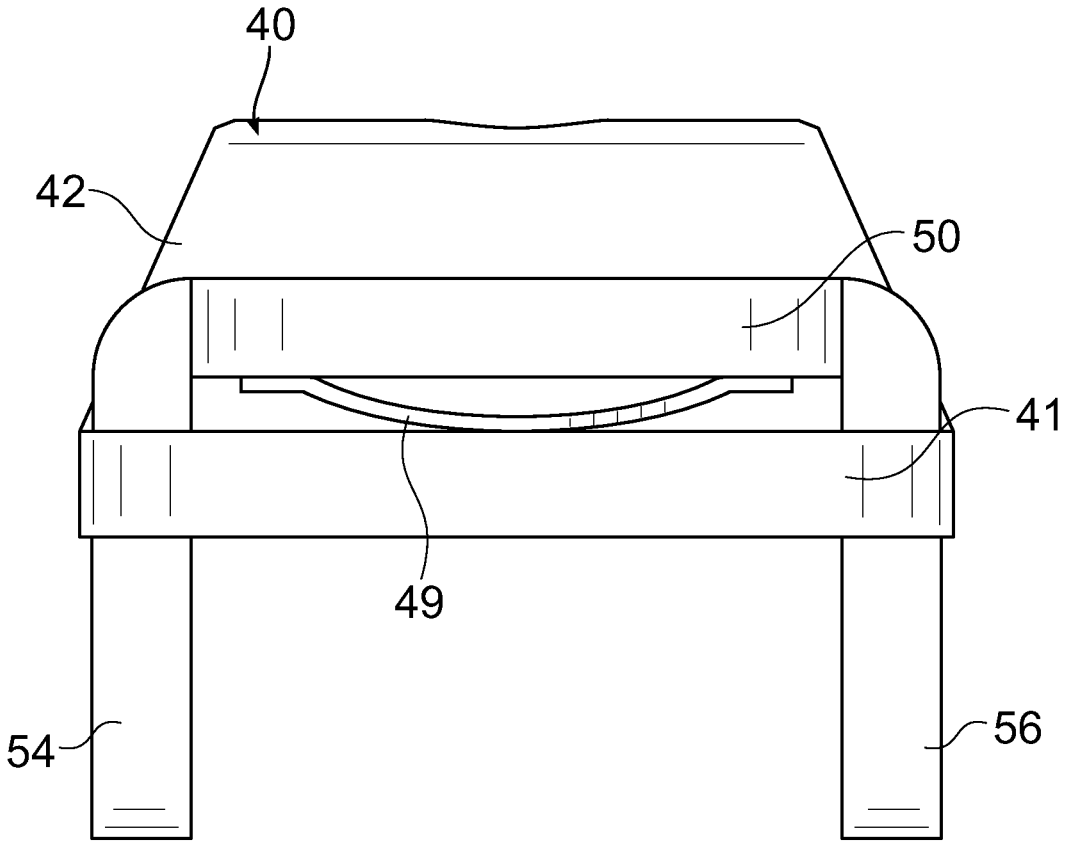
FIG. 11 is a bottom view of a card holder of a shielding card holder system in accordance with an example embodiment.

The first holder magnet 47 is primarily utilized for securing the card holder 40 to the card protector 20 such as shown in FIGS. 9 and 10. Thus, the first holder magnet 47 is generally adapted to magnetically engage with the corresponding first protector magnet 33 of the card protector 20. In a preferred embodiment, the polarity of the second (inner) surface 85 of the first holder magnet 47 will be opposite to the polarity of the first (outer) surface 80 of the first protector magnet 33 such that the first protector magnet 33 and first holder magnet 47 are attracted to each other for securing the card holder 40 against the card protector 20. Preferably, the polarity of the second (inner) surface 85 of the first holder magnet 47 will be the same as the polarity of the outer surface of the second protector magnet 35 such that the first holder magnet 47 does not inadvertently engage with the second protector magnet 35, rather than the first protector magnet 33. As best shown in FIGS. 5A and 5B, the card holder 40 also includes a second member 50 which is pivotable with respect to the first member 41. The second member 50 is illustrated as comprising a central portion 51 from which a pair of arms 54, 56 extends rearwardly such as shown in FIGS. 5A and 5B. The central portion 51 may comprise various shapes, such as a substantially rectangular shape as shown in the figures.

Continuing to reference FIGS. 5A and 5B, it can be seen that the second member 50 includes a first arm 54 and a second arm 56. The first arm 54 is adapted to press against the first projection 44*a* of the first member 41 and the second arm 56 is adapted to press against the second projection 44*b* of the first member 41 such that the card 70 may be secured between the respective projections 44*a*, 44*b* of the first member 41 and the respective arms 54, 56 of the second member 50. The first and second members 41, 50 may be biased towards each other such that, absent application of force, the first arm 54 of the second member 50 is pressed against the first projection 44*a* of the first member 41 and the second arm 56 of the second member 50 is pressed against the second projection 44*b* of the first member 41.

As best shown in FIGS. 5A and 5B, the arms 54, 56 may each include teeth 55, 57 which aid with gripping the card 70. More specifically, it can be seen that the first arm 54 of the second member 50 includes first teeth 55 and that the second arm 56 of the second member 50 includes second teeth 57. The shape, size, and number of teeth 55, 57 may vary in different embodiments. In some embodiments, the teeth 55, 57 may be omitted. In other embodiments, the teeth 55, 57 may instead be replaced by a rubber or plastic strip or the like. Where teeth 55, 57 are utilized, various materials may be utilized, including metals, plastics, rubbers, and the like.

In the embodiment shown in FIG. 5B, the central portion 51 includes an opening 52 in which a second holder magnet 53 may be positioned. Such an opening 52 may be omitted in some embodiments. The opening 52 may or may not extend through the entire body of the second member 50. Thus, the configuration of the opening 52 may vary in different embodiments such that the second holder magnet 53 may be visible from the outer end of the second member 50, or not be visible from the outer end of the second member 50.

As shown in FIG. 5B, the second member 50 may include a second holder magnet 53. The second holder magnet 53 may be visible from both the outer and inner surfaces of the second member 50, or may be only visible on the inner surface of the second member 50. The type, strength, and polarization of the second holder magnet 53 may vary in different embodiments. The second holder magnet 53 may comprise a first surface 86 such as an outer surface and a second surface 87 opposite to the first surface 86, such as an inner surface. The second holder magnet 53 may have a first polarity on the first surface 86 and a second polarity on the second surface 87. The second holder magnet 53 will generally comprise a permanent (as opposed to temporary) magnet such as but not limited to neodymium iron boron, samarium cobalt, alnico, ceramic, and ferrite magnets. In some embodiments, electromagnets may be utilized.

The shape of the second holder magnet 53 may vary in different embodiments. In the embodiment shown in the figures, the second holder magnet 53 is illustrated as comprising a rectangular shape. It should be appreciated that various other shapes may be utilized for the second holder magnet 53, and thus the rectangular shape, including dimensions, shown in the figures should not be construed as limiting. The positioning and orientation of the second holder magnet 53 on the second member 50 of the card holder 40 may also vary and should not be construed as limited by the exemplary figures.

In embodiments in which it is included, the second holder magnet 53 will function in concert with the first holder magnet 47 to bias the card holder 40 into its closed position in the absence of application of force. Accordingly, the polarity of the second (inner) surface 87 of the second holder magnet 53 will preferably be the same as the polarity of the first (outer) surface 84 of the first holder magnet 47 such that the second (inner) surface 87 of the second holder magnet 53 is repelled by the first (outer) surface 84 of the first holder magnet 47. When the first member 41 and second member 50 of the card holder 40 are pushed away from each other by magnetic repulsion between the matching polarities of the first and second holder magnets 47, 53, the arms 54, 56 of the second member 50 are drawn closer to the projections 44*a*, 44*b* of the first member 41 such that the card holder 40 is biased towards the closed position.

As shown throughout the figures, the first and second members 41, 50 work in concert such that the card holder 40 may function as a clip for the card 70. The card holder 40 may be opened so as to receive a card 70 by pressing on the handle 42 to overcome both the bias force of the bias member 49 and/or the magnetic repulsion force of the first and second holder magnets 47, 53 such that the first and second members 41, 50 pivotally open to receive the card 70. Upon release of the handle 42, the bias force of the bias member 49 and/or the magnetic repulsion of the first and second holder magnets 47, 53 will draw the projections 44*a*, 44*b* and arms 54, 56 of the card holder 40 into a closed position to secure the card 70 therein.

The manner in which the card holder 40 is opened or closed may vary in different embodiments. In the embodiment shown in FIG. 5A a bias member 49 is utilized to bias the card holder 40 towards a closed position in which the first and second members 41, 50 of the card holder 40 are pressed against each other. The type of bias member 49 utilized may vary in different embodiments. In the exemplary embodiment shown in FIGS. 5A, 11, 12A, 12B, and 12C, the bias member 49 may comprise a leaf spring which is positioned between the first and second members 41, 50 of the card holder 40. In some embodiments, the bias member 49 may be magnetized, such as by being comprised of a magnetic material.

The bias member 49 is positioned between the first and second members 41, 50 of the card holder 40 so as to bias the first and second members 41, 50 towards each other. The bias member 49 is positioned between the main body of the first member 41 and the central portion 51 of the second member 50.

Because of the placement of the arms 54, 56, which extend rearwardly from the central portion 51 of the second member 50, the force of the bias member 49 applied between the first and second members 41, 50 functions to press the arms 54, 56 of the second member 50 against the projections 44*a*, 44*b* of the first member 41 such as shown in FIGS. 12A, 12B, and 12C.

In the embodiment shown in FIG. 5B, the card holder 40 may comprise a first holder magnet 47 connected to the first member 41 and a second holder magnet 53 connected to the second member 50 such that the first and second holder magnets 47, 53 are adapted to magnetically repulse each other, biasing the projections 44*a*, 44*b* and arms 54, 56 of the card holder 40 towards each other into the closed position. Thus, the card holder 40 of such an embodiment may be biased towards the closed position by the magnetic repulsion between the first and second holder magnets 47, 53.

An alternate embodiment of the card holder 40 is shown in FIGS. 13A, 13B, and 13C. In such an alternate embodiment, a bias member 49 and second holder magnet 53 may be omitted entirely. Instead, a fastener 48 such as a screw or the like is utilized to open and close the card holder 40. The fastener 48 is positioned to extend through both the first member 41 and the second member 50 of the card holder 40. Rotating the fastener 48 in a first direction tightens the fastener so as to draw the first projection 44*a* of the first member 41 towards the first arm 54 of the second member 50 and the second projection 44*b* of the first member 41 towards the second arm 56 of the second member 50 to close the card holder 40. Rotating the fastener 48 in a second, opposite direction loosens the fastener to as to separate the first and second members 41, 50 to open the card holder 40.

The type of fastener 48 utilized may vary in different embodiments. The fastener 48 may include a knob or the like, such as a watch knob, to ease rotation of the fastener 48. The fastener 48 may comprise various types of materials. In a preferred embodiment, the fastener 48 may comprise a magnetically-attractive metal.

D. Securing Member

As shown throughout the figures, a securing member 60 may be provided to aid in wearing the card protector 20. As best shown in FIGS. 15-20, the securing member 60 is adapted to be coupled to the card protector 20, with clothing being sandwiched between the inner surface 26 of the card protector 20 and the securing member 60. In this manner, the card protector 20 may be worn on an individual 12 by securing the card protector 20 to an article of clothing 13 with the securing member 60. The securing member 60 may also be directly secured against the card protector 20 for various other functions, such as for extending a strap 14 through one or more of the central openings 67 of the securing member 60 as discussed herein.

In further embodiments, the securing member 60 may be utilized to secure the card protector 20 against a belt, with the card protector 20 positioned on the outer surface of the belt and the securing member 60 positioned on the inner surface of the belt. The securing member 60 may thus function as a belt clip in some embodiments. In such embodiments, the securing member 60 may be curved or bent to more easily fit over a belt. The securing member 60 may be fixedly secured at its upper end 61 to the inner surface 26 of the card protector 20 in some embodiments so as to function as such a belt clip. In such embodiments, the first and/or second securing magnets 64, 66 may be omitted.

The securing member 60 will generally comprise an elongated, rectangular member having an upper end 61, a lower end 62, a first side 68, and a second side 69. However, various other shapes may be utilized for the securing member 60, and thus the shape and size shown in the figures should not be construed as limiting in scope. While the figures illustrate that the securing member 60 is approximately the same length as the card holder 40, it should be appreciated that the securing member 60 may be longer than, or shorter than, the card holder 40 in different embodiments.

In the exemplary embodiment shown in FIGS. 9 and 10, the securing member 60 may include a pair of securing magnets 64, 66 which are utilized to couple the securing member 60 with the card holder 40. As shown in FIGS. 5A and 5B, the securing member 60 may include an upper magnet opening 63 and a lower magnet opening 65. The securing magnets 64, 66 may be removably or fixedly attached within the magnet openings 63, 65. In some embodiments, the magnet openings 63, 65 may be omitted, with the securing magnets 64, 66 being fixedly attached to the surface of the securing member 60, or integrally formed therewith. The securing magnets 64, 66 may be flush with the surface of the securing member 60, may extend past the surface of the securing member 60, or may be depressed with respect to the surface of the securing member 60.

The type, strength, and polarization of the securing magnets 64, 66 may vary in different embodiments. The securing magnets 64, 66 may have a first polarity on the first side and a second polarity on the second side. The securing magnets 64, 66 will generally comprise permanent (as opposed to temporary) magnets such as but not limited to neodymium iron boron, samarium cobalt, alnico, ceramic, and ferrite magnets. In some embodiments, electromagnets may be utilized.

In a preferred embodiment in which the first protector magnet 33 has a reversed polarity configuration when compared with the second protector magnet 35, the first securing magnet 64 will similarly have a reverse polarity configuration when compared to the second securing magnet 66. Thus, in such a preferred embodiment, the first side of the first securing magnet 64 will have an opposite polarity with respect to the first side of the second securing magnet 66. Such a configuration is utilized such that the first and second protector magnets 33, 35 may have opposite polarities without affecting magnetic attraction with the securing magnets 64, 66.

The shape of the securing magnets 64, 66 may vary in different embodiments. In the embodiment shown in the figures, each of the securing magnets 64, 66 is illustrated as comprising a rectangular shape. It should be appreciated that various other shapes may be utilized for the securing magnets 64, 66, and thus the rectangular shape, including dimensions, shown in the figures should not be construed as limiting.

The positioning of the securing magnets 64, 66 may vary in different embodiments. In the exemplary embodiment shown in FIGS. 9 and 10, the first securing magnet 64 is positioned near the upper end 61 of the securing member 60 and the second securing magnet 66 is positioned near the lower end 62 of the securing member 60. In some embodiments, one or both securing magnets 64, 66 may be omitted. In embodiments in which the securing member 60 does not include any securing magnets 64, 66, the securing member 60 may itself be comprised of a magnetically-attractive material so as to magnetically engage with the first and second protector magnets 33, 35 directly.

As shown in FIGS. 9 and 10, the securing member 60 may include one or more central openings 67. These central openings 67 may be utilized for a wide range of functions. By way of example, a strap 14 may be inserted through one or more of the central openings 67 to aid in wearing the card holder 40. The number of central openings 67 may vary in different embodiments and thus should not be construed as limited by the exemplary figures. Further, the size of the central openings 67 may also vary. In some embodiments, different sizes may be used for each of the central openings 67.

The central openings 67 are illustrated as being linearly aligned as they extend between the upper and lower ends 61, 62 of the securing member 60. It should be appreciated that the positioning and orientation of the central openings 67 may vary in different embodiments. Thus, the positioning and orientation shown in the figures should not be construed as limiting in scope.

As previously described, the inner surface 26 of the card protector 20 may include ribs 36*a*, 36*b*, 37*a*, 37*b* which form a guide or track for the securing member 60. Thus, the securing member 60 may be secured to the card protector 20 such that the first ribs 36*a*, 37*a* are positioned on a first side 68 of the securing member 60 and the second ribs 36*b*, 37*b* are positioned on a second side 69 of the securing member 60. In this manner, the securing member 60 will be prevented from shifting or moving from side-to-side, and thus anchored in place. The ribs 36*a*, 36*b*, 37*a*, 37*b* also provide a guide for ideal positioning of the securing member 60 on the card protector 20.

E. Operation of Preferred Embodiment

The systems and methods described herein may be utilized for the protection and shielding wireless transmissions or communications of a wide range of devices, including but not limited to various types of cards 70 such as identification cards, credit cards, RFID badges and the like. More specifically, the card protector 20 may be utilized so as to cover all but the front face of the card 70, with the sides of the card 70 being covered by the outer flange 27 of the card protector 20 to shield wireless transmissions. By positioning the card 70 into the card holding space 28 of the card protector 20, one can protect and shield the card 70 from intrusion such as skimming of wireless transmissions.

In use, the card 70 is generally first secured within the card holder 40. The card holder 40 may be opened into its opened position to receive the card 70, and then closed into its closed position to secure the card 70 within the card holder 40. In a first embodiment as shown in FIGS. 12A, 12B, and 12C, an individual 12 may grasp the handle 42 of the card holder 40 and press downwardly, which separates the first member 41 and the second member 50 of the card holder 40. The card 70 may be inserted between the first and second members 41, 50 of the card holder 40 and then the handle 42 may be released.

Upon release of pressure on the handle 42, the first and second members 41, 50 will revert back to their original position by force of the bias member 49 and/or holder magnets 47, 53. In such an original position, the card 70 will be secured between the projections 44*a*, 44*b* of the first member 41 of the card holder 40 and the arms 54, 56 of the second member 50 of the card holder 40 such as shown in FIG. 12C.

To remove the card 70, pressure may be applied again to the handle 42 to open the card holder 40 by moving the first and second members 41, 50 away from each other. With the handle 42 depressed and the card holder 40 in the opened position, the card 70 may be safely removed from the card holder 40. The handle 42 may then be released, with the first and second members 41, 50 reverting back to their original closed position by force of the bias member 49 and/or first and second holder magnets 47, 53.

In an alternate embodiment as shown in FIGS. 13A, 13B, and 13C, a fastener 48 may instead be utilized to open and close the card holder 40. In such an embodiment, the fastener 48 may be loosened by rotating in a first direction so as to draw the first and second members 41, 50 of the card holder 40 away from each other for the card 70 to be inserted therein. The fastener 48 may then be tightened by rotating in a second direction to draw the first and second members 41, 50 of the card holder 40 towards each other to secure the card 70 within the card holder 40 such as shown in FIG. 13C.

To remove the card 70 from the card holder 40 in the embodiment of FIGS. 13A, 13B, and 13C, the fastener 48 may again be loosened to draw the first and second members 41, 50 of the card holder 40 away from each other such that the card holder 40 is in the opened position. The card 70 may then be removed from between the first and second members 41, 50 of the card holder 40. The fastener 48 may be tightened again to close the card holder 40 until such time as the previous card 70 or a new card 70 is to be inserted using the steps described in the paragraph above.

With the card 70 secured within the card holder 40, the card holder 40 may be secured to the card protector 20. It should be appreciated, however, that in some embodiments the card holder 40 may first be secured to the card protector 20, followed by insertion of the card 70 into the card holder 40. The order in which the card 70 is inserted into the card holder 40 (i.e., before or after the card holder 40 is secured to the card protector 20) may thus vary in different embodiments and to suit the needs of different individuals 12.

To secure the card holder 40 to the card protector 20, one need only position the card holder 40 such that the first holder magnet 47 is brought near to the first protector magnet 33. To prevent the first holder magnet 47 from inadvertently engaging with the second protector magnet 35, the polarity of the outer surface of the second protector magnet 35 may be the same as the polarity of the inner surface of the first holder magnet 47 such that the first holder magnet 47 is repelled from the second protector magnet 35.

Upon the first protector magnet 33 and first holder magnet 47 being near each other, they will be magnetically attracted so as to removably secure the first holder magnet 47 against the first protector magnet 33. In this manner, the card holder 40 may be removably attached to the card protector 20. The card 70 will rest within the card holding space 28 of the card protector 20, with the outer flange 27 covering the sides of the card 70 such as shown in FIGS. 1 and 15.

When it is desired to use the card 70, such as to make a payment, access an area, or identify one's self, the card holder 40 and card 70 may be fully removed from the card protector 20 such that the card 70 may be swiped or scanned. The card holder 40 and card 70 may then be easily reconnected to the card protector 20 using the steps described above, with the card holder 40 snapping into place on the card protector 20 when the first protector magnet 33 and first holder magnet 47 are brought near to each other.

Figure 14:
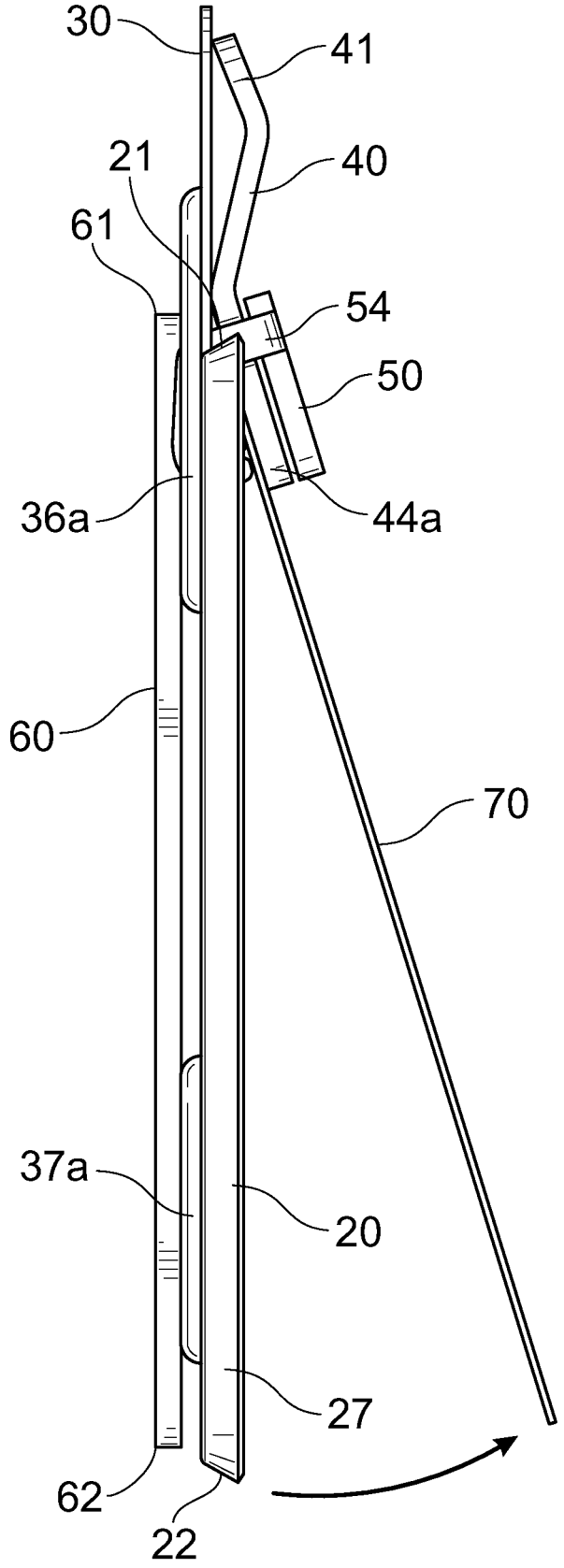
FIG. 14 is a side view of a shielding card holder system with the card holder and card pivoted outwardly in accordance with an example embodiment.

In some situations, it may not be necessary to fully remove the card holder 40 and retained card 70 from the card protector 20. In such situations, one may simply grasp the extended portion 30 of the card protector 20 while pressing down on the handle 42 of the card holder 40, which pivots the card 70 outwardly from the card protector 20 so as to partially expose the rear side of the card 70 such as shown in FIGS. 6 and 14. In such a position, the first protector magnet 33 and first holder magnet 47 remain engaged, with only the bottom of the card 70 being raised from the card protector 20.

An individual 12 may choose to affix the card protector 20, including the attached card holder 40 and retained card 70, to his or her body or to an article of clothing 13. The figures illustrate a number of exemplary methods for securing the card protector 20 to one's self. It should be appreciated that the described and shown methods are merely for exemplary purposes, and are not meant to be exhaustive as there are numerous methods for securing the card protector 20 to one's self. Further, the orientation of the card protector 20 may vary and should not be construed as limited by the figures.

If one desires to secure the card protector 20 to an article of clothing 13, the securing member 60 may be utilized such as shown in FIGS. 15-20. The securing member 60 is positioned on the interior (inside) of the article of clothing 13, such as inside of a shirt. The card protector 20 may then be positioned on the exterior (outside) of the article of clothing 13 in alignment and adjacent with the underlying securing member 60. The securing magnets 64, 66 of the securing member 60 will magnetically engage through the clothing 13 with the protector magnets 33, 35 of the card protector 20, thus sandwiching the article of clothing 13 between the card protector 20 and the securing member 60. In this manner, the card protector 20 may be secured against an article of clothing 13.

While the figures illustrate the article of clothing 13 as comprising a shirt of an individual 12, it should be appreciated that the securing member 60 may be utilized to secure the card protector 20 against a wide range of types of articles of clothing 13, including but not limited to pants, shorts, sweaters, jackets, hats, belts and the like. Further, in some embodiments or with certain types of cards 70, it may be desirable to secure the card protector 20 horizontally, rather than vertically as shown in the figures.

Figure 16:
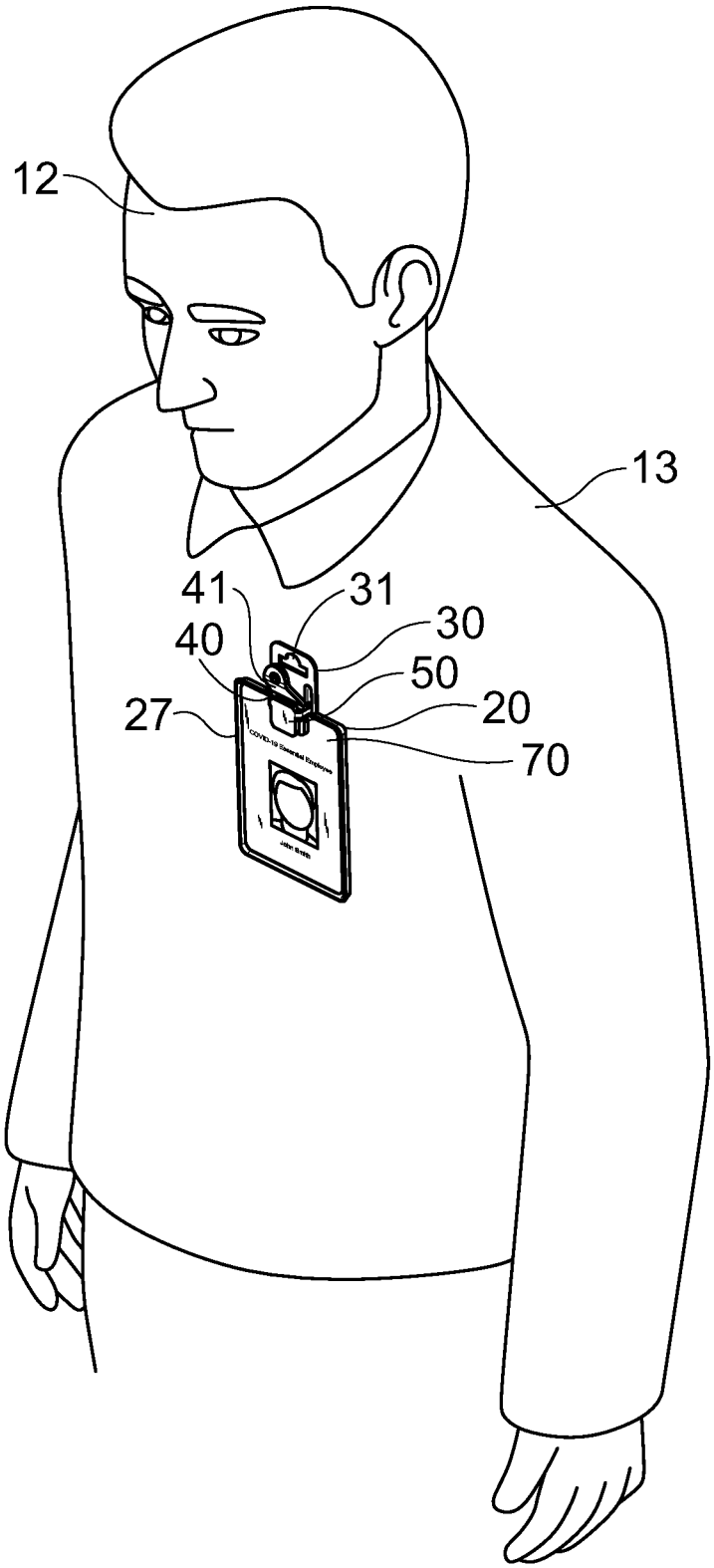
FIG. 16 is a perspective view of a shielding card holder system in use and being worn on an article of clothing in accordance with an example embodiment.
Figure 17:
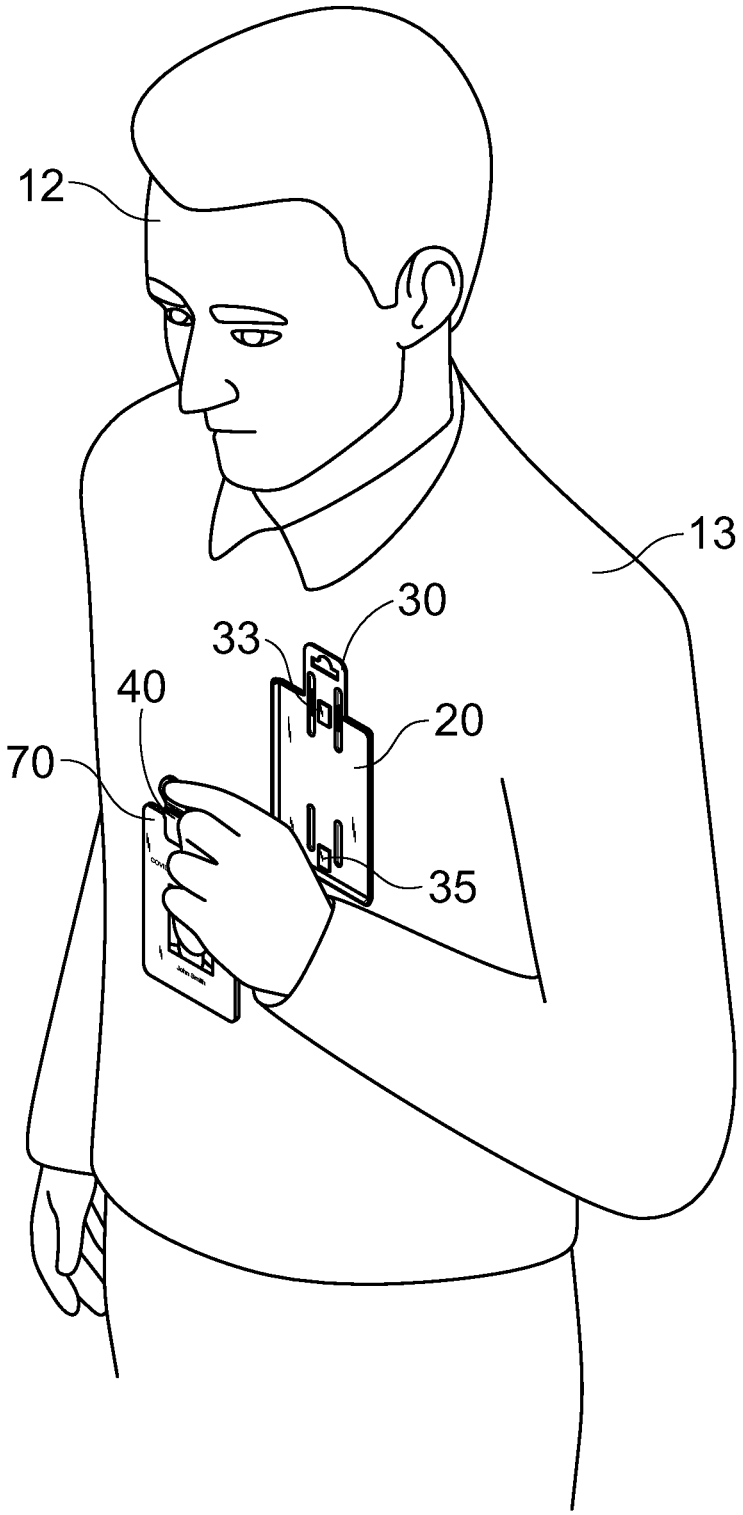
FIG. 17 is a perspective view illustrating removal of a card and card holder from a card protector of a shielding card holder system being worn on an article of clothing in accordance with an example embodiment.

FIG. 16 illustrates a card protector 20 being secured against a shirt of an individual 12, with the securing member 60 not being visible as it is underneath the shirt adjacent to the card protector 20. FIG. 17 illustrates the individual 12 completely removing the card holder 40 and card 70 together for use. After use, the card holder 40 and attached card 70 may be snapped back onto the card protector 20 as described previously.

Figure 18:
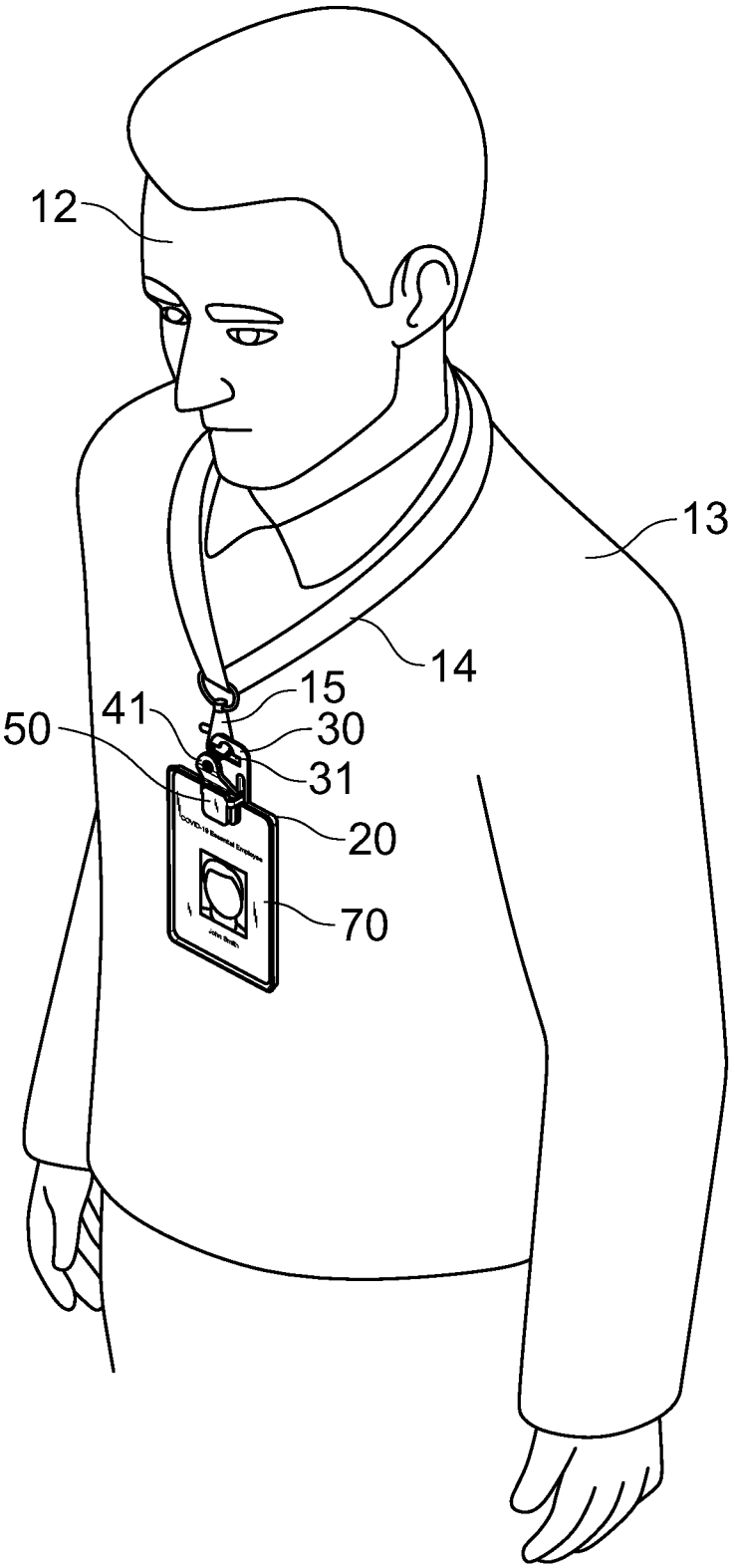
FIG. 18 is a perspective view of a shielding card holder system in use and being worn around the neck in accordance with an example embodiment.
Figure 19:
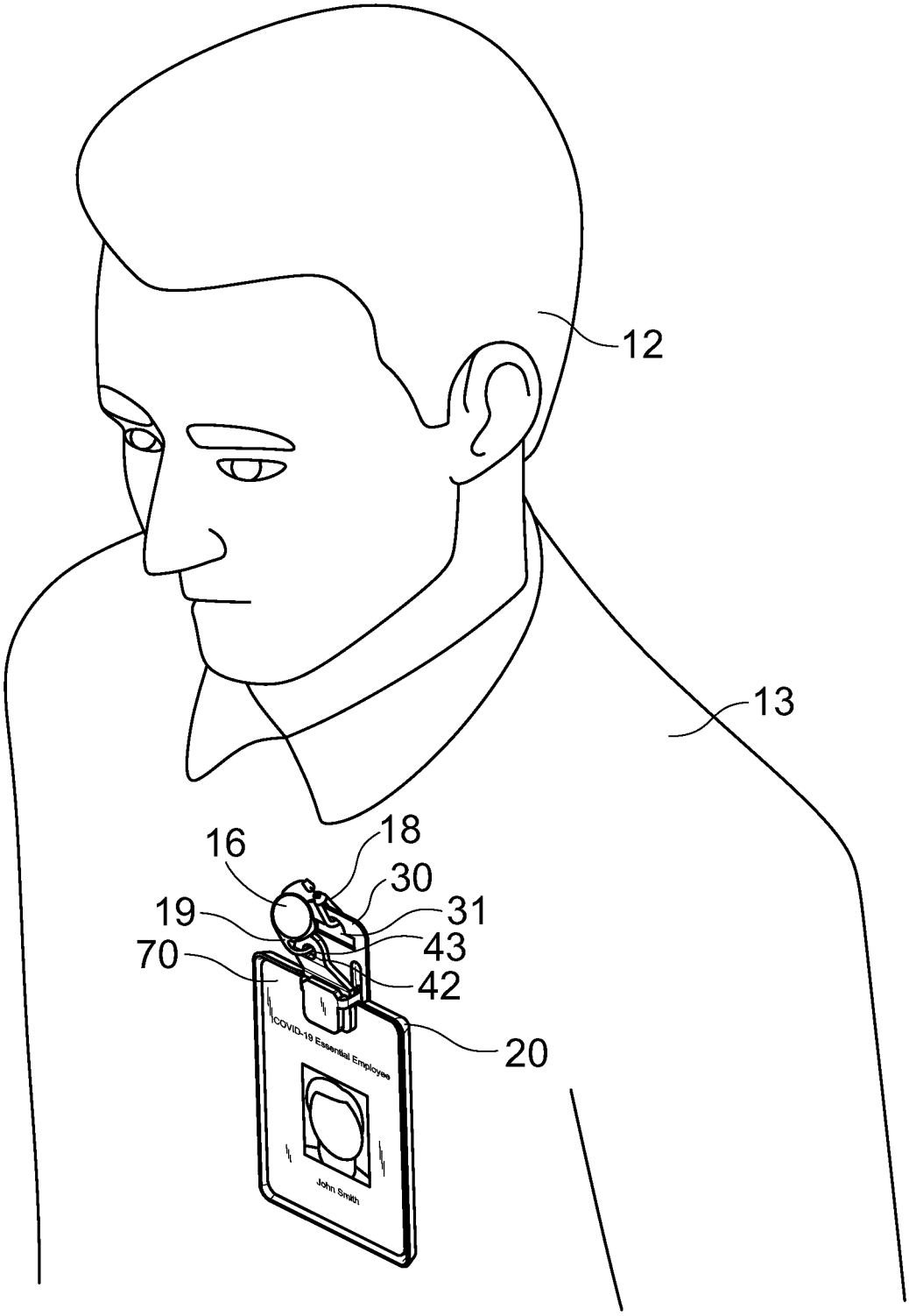
FIG. 19 is a perspective view of a shielding card holder system in use and being worn on an article of clothing in accordance with an example embodiment.
Figure 20:
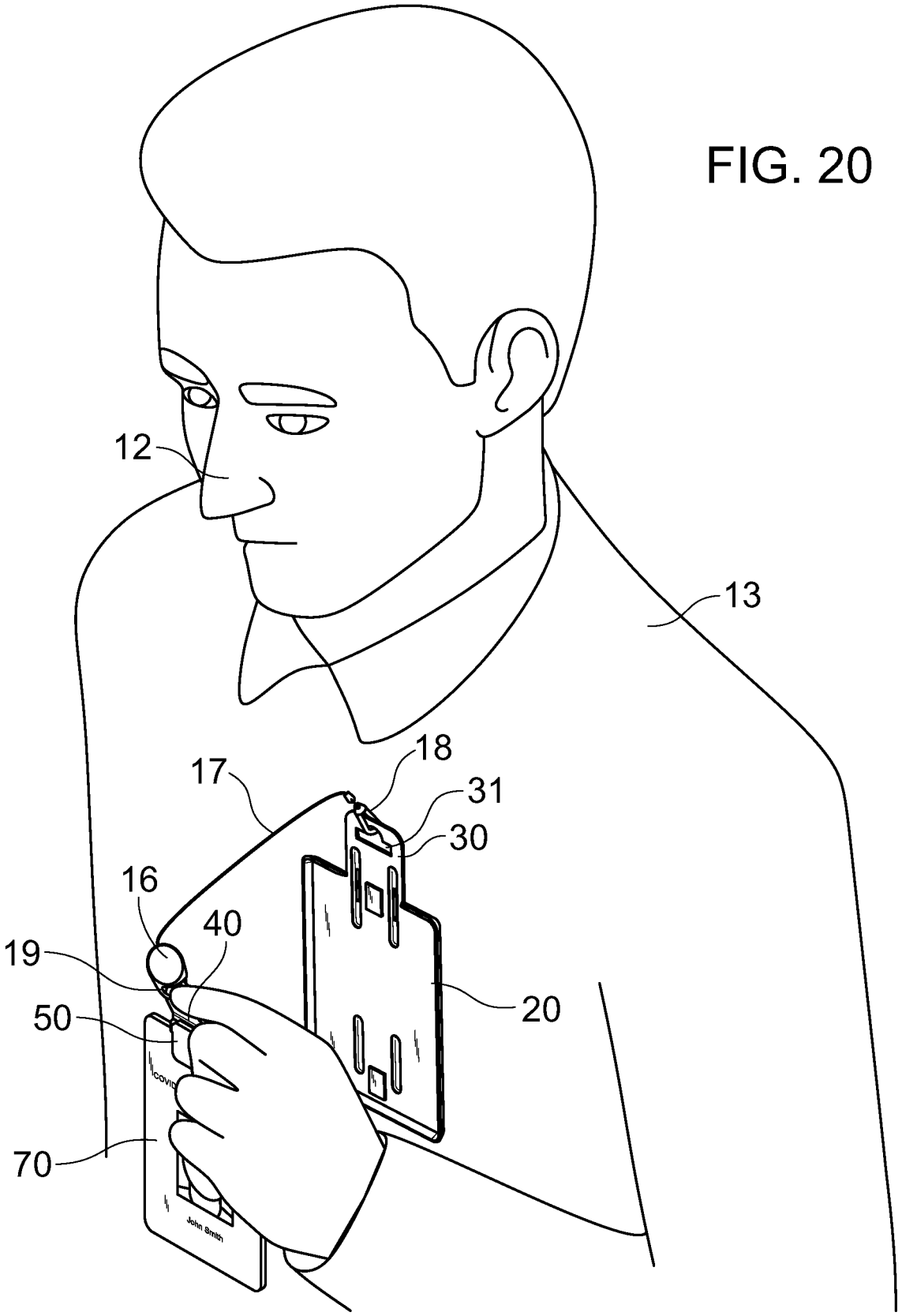
FIG. 20 is a perspective view of a shielding card holder system in which the card holder is linked to the card protector by an extension reel in accordance with an example embodiment.

It may be desirable to wear the card protector 20 around one's neck with a strap 14 such as a lanyard or the like. FIG. 18 illustrates the card protector 20 being worn around the neck of an individual 12. As shown, the strap connector 15 which is generally a clip may be secured to the opening 31 of the extended portion 30 of the card protector 20. Although not shown, the strap connector 15 may be connected to various other locations on the card protector 20, card holder 40, or securing member 60. For example, the opening 43 on the handle 42 of the card holder 40 may be utilized as a connection point for the strap connector 15. As another example, one or more of the central openings 67 on the securing member 60 may serve the same function.

It may be desirable to link the card holder 40 to the card protector 20, such as with a strap or the like. In the embodiment shown in FIGS. 19 and 20, an extension reel 16 is utilized which anchors the card holder 40 to the card protector 20 while still allowing the card holder 40 to be removed from the card protector 20. In such an embodiment, the first connector 18 of the extension cord 17 extending from the extension reel 16 may be connected to the card protector 20, such as to the opening 31 on the extended portion 30 of the card protector 20. The second connector 19 of the extension cord 17 may be connected to the card holder 40, such as the opening 43 of the handle 42 of the card holder 40. Thus, the individual 12 may pull the card holder 40 and attached card 70 away from the card protector 20, with the extension cord 17 anchoring the card holder 40 to the card protector 20. Upon releasing the card holder 40, the extension reel 16 will reel in the extension cord 17 to bring the card holder 40 and card 70 back to the card protector 20 to be secured in place.

Unless otherwise defined, all technical and scientific terms used herein have the same meaning as commonly understood by one of ordinary skill in the art to which this invention belongs. Although methods and materials similar to or equivalent to those described herein can be used in the practice or testing of the shielding card holder system, suitable methods and materials are described above. All publications, patent applications, patents, and other references mentioned herein are incorporated by reference in their entirety to the extent allowed by applicable law and regulations. The shielding card holder system may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A shielding card holder system, comprising:

a card protector for shielding wireless transmissions from a card, the card protector comprising an upper end, a lower end, an outer surface, and an inner surface;

a first protector magnet connected to the card protector, wherein the first protector magnet comprises a first surface and a second surface opposite of the first surface; and a card holder removably attached to the outer surface of the card protector, wherein the card holder is adjustable between an opened position and a closed position, wherein the card holder is adapted to removably hold the card within the card holder when the card holder is in the closed position, wherein the card holder is adapted to magnetically engage with the first surface of the first protector magnet so as to removably attach the card holder to the card protector.

2. The shielding card holder system of claim 1, further comprising a securing member removably attached to the inner surface of the card protector.

3. The shielding card holder system of claim 2, further comprising a first securing magnet connected to the securing member, wherein the first securing magnet is adapted to magnetically engage with the second surface of the first protector magnet so as to removably attach the securing member to the card protector.

4. The shielding card holder system of claim 3, further comprising a second protector magnet connected to the card protector.

5. The shielding card holder system of claim 4, further comprising a second securing magnet connected to the securing member, wherein the second securing magnet is adapted to magnetically engage with the second protector magnet so as to removably attach the securing member to the card protector.

6. The shielding card holder system of claim 5, wherein the first protector magnet is connected near the upper end of the card protector and wherein the second protector magnet is connected near the lower end of the card protector.

7. The shielding card holder system of claim 6, wherein the first securing magnet is connected near the upper end of the securing member and wherein the second securing magnet is connected near the lower end of the securing member.

8. The shielding card holder system of claim 1, wherein the card protector comprises a flange extending at least partially around an outer edge of the outer surface of the card protector.

9. The shielding card holder system of claim 1, wherein the card holder comprises a first member and a second member, wherein the first member and the second member are movably connected such that the card holder is adjustable between an opened position and a closed position.

10. The shielding card holder system of claim 9, wherein the card holder comprises a bias member for biasing the card holder towards the closed position.

11. The shielding card holder system of claim 10, wherein the bias member is connected between the first member and the second member.

12. The shielding card holder system of claim 11, wherein the bias member is comprised of a leaf spring.

13. The shielding card holder system of claim 10, wherein the bias member is comprised of a magnetic material.

14. The shielding card holder system of claim 9, further comprising a fastener connected between the first member and the second member, the fastener being rotatable to adjust the card holder between the opened position and the closed position.

15. A shielding card holder system, comprising:

a card protector for shielding wireless transmissions from a card, the card protector comprising an upper end, a lower end, an outer surface, and an inner surface;

a first protector magnet connected to the card protector, wherein the first protector magnet comprises a first surface and a second surface opposite of the first surface;

a card holder removably attached to the outer surface of the card protector, the card holder being adapted to removably hold the card within the card holder, wherein the card holder is adjustable between an opened position and a closed position;

a first holder magnet connected to the card holder, wherein the first holder magnet is adapted to magnetically engage with the first surface of the first protector magnet so as to removably attach the card holder to the card protector;

a securing member removably attached to the inner surface of the card protector; and a first securing magnet connected to the securing member, wherein the first securing magnet is adapted to magnetically engage with the second surface of the first protector magnet so as to removably attach the securing member to the card protector.

16. The shielding card holder system of claim 15, further comprising a second protector magnet connected to the card protector.

17. The shielding card holder system of claim 16, further comprising a second securing magnet connected to the securing member, wherein the second securing magnet is adapted to magnetically engage with the second protector magnet so as to removably attach the securing member to the card protector.

18. The shielding card holder system of claim 15, wherein the card protector comprises a flange extending at least partially around an outer edge of the outer surface of the card protector.

19. The shielding card holder system of claim 15, wherein the card holder comprises a first member and a second member, wherein the first member is movable with respect to the second member so as to adjust the card holder between the opened position and the closed position, wherein the first holder magnet is connected to the first member and further comprising a second holder magnet connected to the second member, wherein the first holder magnet and the second holder magnet are adapted to magnetically bias the card holder towards the closed position.

20. A method of wearing a card utilizing the shielding card holder system of claim 15, comprising the steps of:

securing the card within the card holder;

attaching the card holder to the card protector;

positioning the securing member against an interior of an article of clothing; and positioning the card protector against an exterior of the article of clothing adjacent to the securing member such that the first protector magnet of the card protector magnetically engages with the first securing magnet of the securing member through the article of clothing.

* * * * *